US008743158B2

(12) United States Patent
Kang

(10) Patent No.: US 8,743,158 B2
(45) Date of Patent: Jun. 3, 2014

(54) HIGH DYNAMIC RANGE DISPLAY WITH THREE DIMENSIONAL AND FIELD SEQUENTIAL COLOR SYNTHESIS CONTROL

(75) Inventor: Michael J. S. Kang, North Vancouver, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 286 days.

(21) Appl. No.: 13/266,984

(22) PCT Filed: Apr. 29, 2010

(86) PCT No.: PCT/US2010/032921

§ 371 (c)(1),
(2), (4) Date: Oct. 28, 2011

(87) PCT Pub. No.: WO2010/127080

PCT Pub. Date: Nov. 4, 2010

(65) Prior Publication Data

US 2012/0044281 A1 Feb. 23, 2012

Related U.S. Application Data

(60) Provisional application No. 61/174,323, filed on Apr. 30, 2009.

(51) Int. Cl.
*G09G 5/10* (2006.01)

(52) U.S. Cl.
USPC ..... 345/690

(58) Field of Classification Search
None
See application file for complete search history.

(56) References Cited

U.S. PATENT DOCUMENTS

| | | | | |
|---|---|---|---|---|
| 6,911,963 | B2 | 6/2005 | Baba | |
| 7,453,475 | B2 * | 11/2008 | Nitta et al. | 345/690 |
| 7,830,358 | B2 | 11/2010 | Seetzen | |
| 8,038,316 | B2 | 10/2011 | Silverstein et al. | |
| 2008/0204479 | A1 * | 8/2008 | Seetzen | 345/690 |
| 2009/0174638 | A1 * | 7/2009 | Brown Elliott et al. | 345/88 |

(Continued)

FOREIGN PATENT DOCUMENTS

| | | |
|---|---|---|
| CN | 1607422 | 4/2005 |
| CN | 1645469 | 7/2005 |

(Continued)

OTHER PUBLICATIONS

Wang, et al., "Delta-Color Adjustment (DCA) Method for Color Controlled Backlight of High Dynamic Range LCD-TVs" SID 2008, International Symposium, society for Information Display, Los Angeles, USA vol. XXXIX, May 18, 2008, pp. 768-771.

(Continued)

*Primary Examiner* — Adam R Giesy
*Assistant Examiner* — Henok Heyi
(74) *Attorney, Agent, or Firm* — John W. Carpenter

(57) ABSTRACT

Embodiments relate generally to computer-based image processing, and more particularly, to systems, apparatuses, integrated circuits, computer-readable media, and methods to facilitate operation of an image display system with a relatively high dynamic range by, for example, generating a rear modulator sub-image with color compensation techniques. The image display system can produce rear modulator drive levels that would enable a front modulator sub-image to be displayed without color errors arising for a certain color or colors when the image display system includes pixel mosaics.

19 Claims, 16 Drawing Sheets

(56) References Cited

U.S. PATENT DOCUMENTS

| | | | | |
|---|---|---|---|---|
| 2010/0052575 | A1* | 3/2010 | Feng et al. | 315/308 |
| 2011/0193895 | A1 | 8/2011 | Johnson et al. | |
| 2011/0193896 | A1 | 8/2011 | Johnson | |

FOREIGN PATENT DOCUMENTS

| | | |
|---|---|---|
| CN | 1936655 | 3/2007 |
| EP | 1168850 | 1/2002 |
| JP | 3766274 | 4/2006 |

OTHER PUBLICATIONS

Huang, et al., "Adaptive LC/BL Feedback Control in Field Sequential Color LCD Technique for Color Breakup Minimization" Journal of Display Technology, IEEE Service Center, New York, NY, vol. 4, No. 3, Sep. 1, 2008, pp. 290-295.

* cited by examiner

HIGH DYNAMIC RANGE DISPLAY WITH THREE DIMENSIONAL AND FIELD SEQUENTIAL COLOR SYNTHESIS CONTROL

CROSS-REFERENCE TO RELATED APPLICATIONS

This application claims priority to United States Patent Provisional Application No. 61/174,323, filed 30 Apr. 2009, hereby incorporated by reference in its entirety.

FIELD

Embodiments of the invention relate generally to displaying images, and more particularly, to systems, apparatuses, integrated circuits, computer-readable media, and methods to operate an image display system to improve the dynamic range in color reproduction of digital images.

BACKGROUND

High Dynamic Range (HDR) displays may be formed from the optical combination of a Liquid Crystal Display (LCD) panel, and an array of Light Emitting Diodes (LEDs) disposed along an optical path so as to illuminate the LCD panel. Pixel intensities are typically not controlled independently of each other because each LED overlaps many LCD pixels, and contributes to the brightness of the image displayed. The intensities and dynamic ranges of images generated by HDR displays generally exceed those of conventional imaging techniques. Furthermore, techniques of three-dimensional color synthesis and field sequential color synthesis have been developed to enhance digital imagery for various display devices. Yet, many of the display devices have not been well-suited to the combination of such techniques with HDR imaging.

In view of the foregoing, there are continuing efforts to improve systems, apparatuses, integrated circuits, computer-readable media, and methods to operate HDR displays with improved effective high dynamic range for output images.

SUMMARY

Embodiments relate generally to computer-based image processing, and more particularly, to systems, apparatuses, integrated circuits, computer-readable media, and methods to facilitate operation of an image display system with a relatively high dynamic range by, for example, generating a sub-image with color compensation techniques. The image display system can produce target sub-images corresponding to (target) rear modulator drive levels, where such drive levels may enable higher-resolution sub-images to be accurately reproduced and without color errors for certain color(s) at the output of the image display system having an operable filter, which in some examples, may be a pixel mosaic. Suitable target drive levels may be used to correct color errors, locally in some examples, and globally in other examples, in a higher-resolution sub-image that the front modulator is not appropriately modulating for. In at least some embodiments, the target sub-image and the input image may be translated into effective (rear modulator) drive levels by suitable combination functions so as to enable color correction. In some examples, a combination function being a color hierarchical convex combination may be utilized. Local color prioritization, including a color importance map, may be utilized during this transformation in some examples. In at least some embodiments, non-standard pixel mosaics may be utilized along with three-dimensional color synthesis and field sequential color synthesis techniques. Additionally, and in some embodiments, techniques to mitigate artifacts arising from excess light pollution in adjacent image areas may be provided.

BRIEF DESCRIPTION OF THE FIGURES

The invention and its various embodiments are more fully appreciated in connection with the following detailed description taken in conjunction with the accompanying drawings, in which.

Like reference numerals refer to corresponding parts throughout the several views of the drawings. Note that most of the reference numerals include one or two left-most digits that generally identify the figure that first introduces that reference number.

DETAILED DESCRIPTION

Figure 1A:
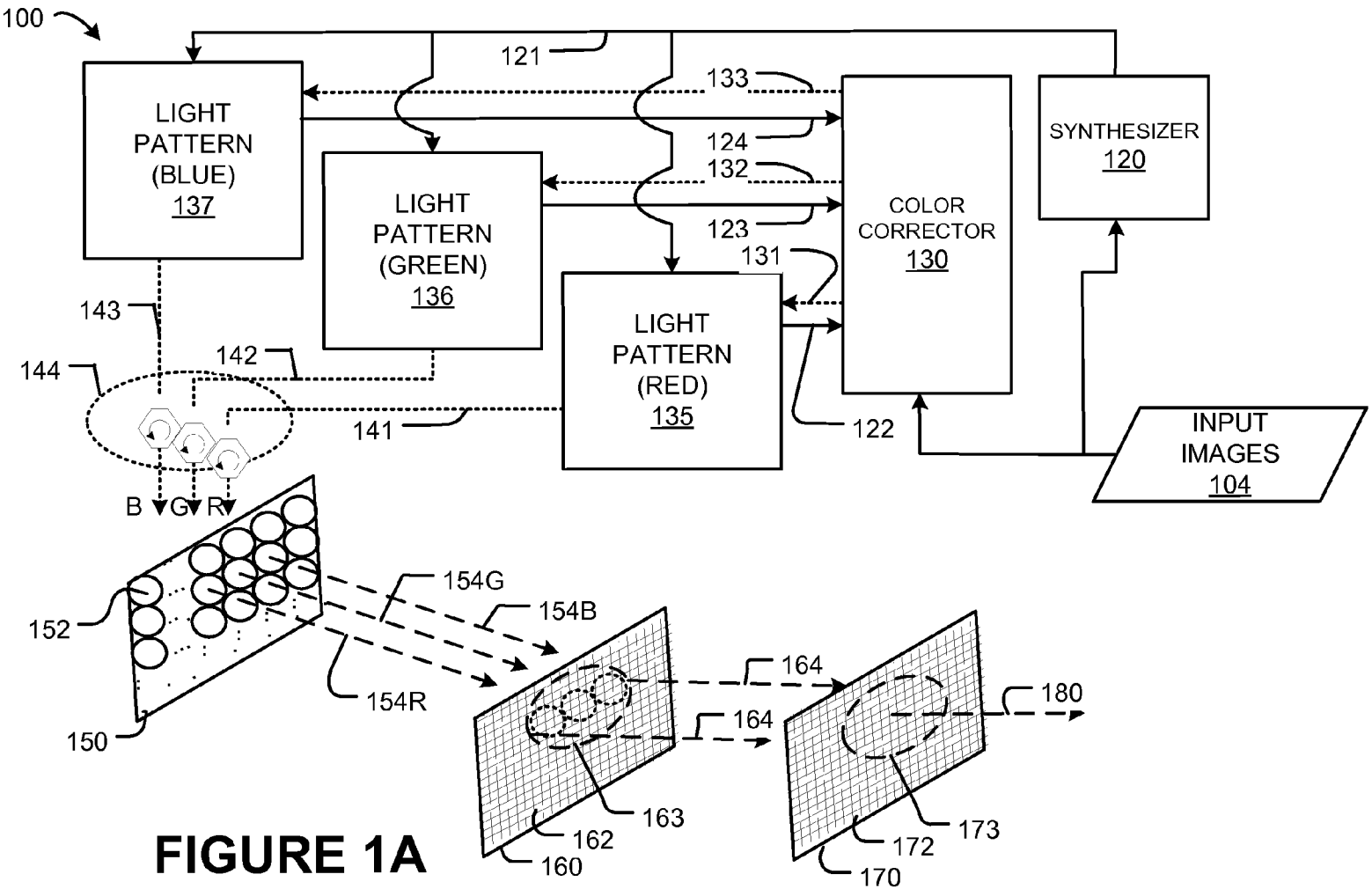
FIGS. 1A-1B illustrate functional block diagrams of operating a rear modulator of an image display system, according to at least some embodiments of the invention.
Figure 1B:
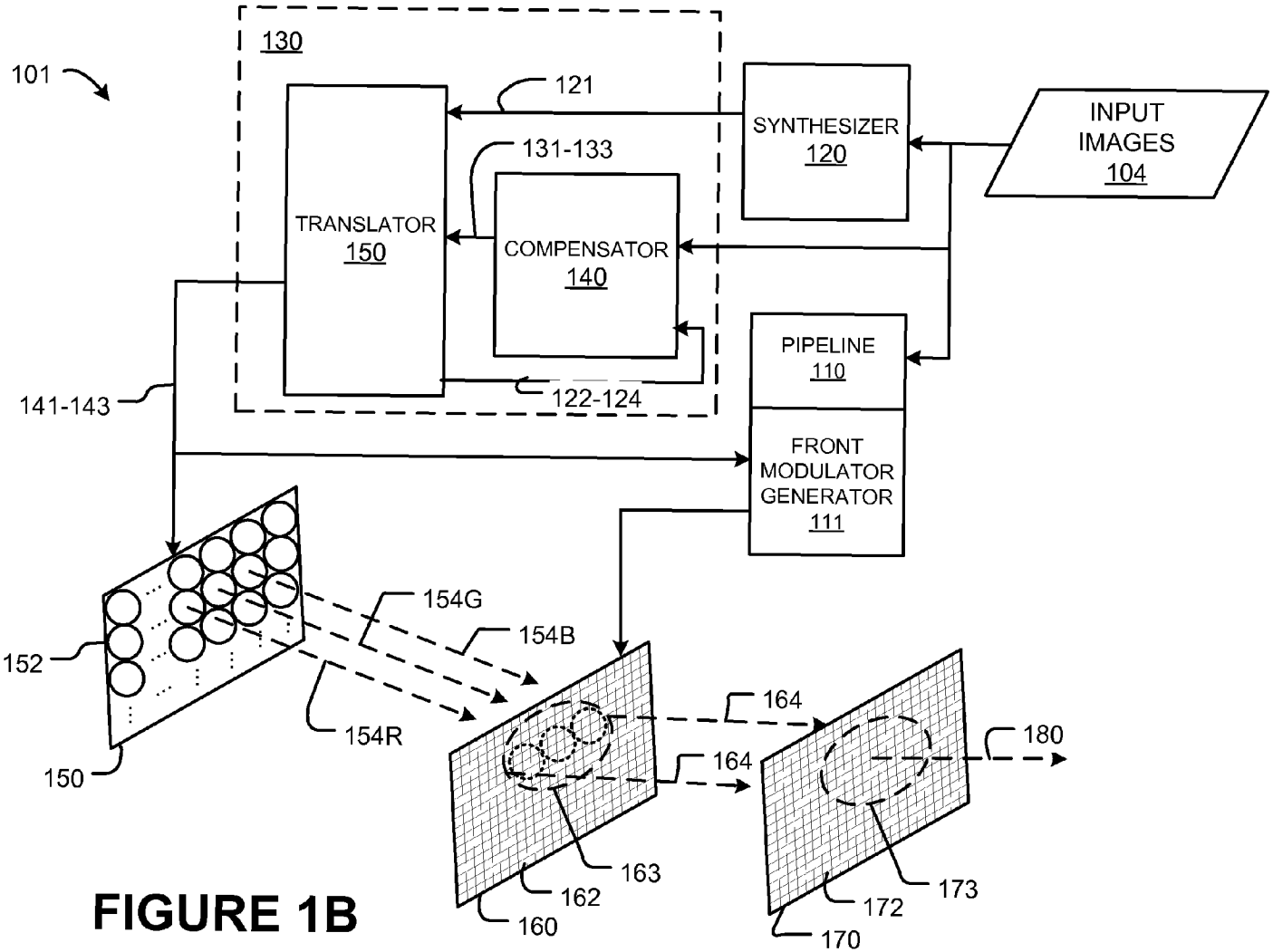

FIGS. 1A-1B illustrate functional block diagrams of operating a rear modulator of an image display system, according to at least some embodiments of the invention. Here in FIG. 1A, diagram 100 depicts a synthesizer 120, a color corrector 130, a rear modulator 150, and a front modulator 160 with a filter 170. Rear modulator 150 includes an array of modulating elements 152, which function as light sources. In some examples, modulating elements 152 emit different colors of light, including red light 154R, green light 154G and blue light 154B. The light 154(R, G, B) may be oriented along an optical path to illuminate a surface of front modulator 160, which includes a plurality of pixels 162.

For example, rear modulator 150 is configured to transmit light patterns as sub-images (not shown), which represent low resolution approximations of input images 104 along an optical path and formed from modulating elements 152 emitting colored light 154(R, G and B). Front modulator 160 can use the low-resolution light patterns to generate higher resolution light patterns for forming higher-resolution sub-images, the combination of which produces the input image 104. The high-resolution light patterns are formed from the light 154 (R, G and B) being incident upon a surface of front modulator 160. In generating the higher-resolution light patterns, the plurality of pixels 162 are controlled to transmit light 164 toward filter 170. In some examples, filter 170 is an array of color elements 172, and color elements 172 include a plurality of sub-pixels. In some examples, the resolution of color elements 172 is of similar resolution to pixels 162. In other examples, color elements 172 are of different resolution than pixels 162. Filter 170 operates to modify the incident light 173 (associated with the higher resolution light patterns) with color additive techniques to produce a displayable image 180 with a visible light spectrum (e.g., all or most of the wavelengths of visible light) including primary colors. Further to the example shown, the light 154 (R, G, and B) emitted from the rear modulator 150 represents a low-resolution sub-image (not shown) of the input image, and is optically multiplied by the higher-resolution sub-image (not shown) to create the displayable image 180. In one example, displayable image 180 is a high dynamic range ("HDR") image, representing input image 104.

Synthesizer 120 can be configured to generate rear modulator drive levels along path 121 based on input images 104. Such rear modulator drive levels enable front modulator 160 to generate a sub-image (e.g., a higher-resolution sub-image) having a luminance profile represented by a light pattern that is modulated without color errors (or with reduced/negligible errors) for a certain color or colors, but may be modulated with color errors for other color or colors when filter 170 is operable. Exemplary techniques where synthesizer 120 for determining the rear modulator drive levels based upon the front modulator 160 having full color control may be found in U.S. Provisional Patent Application No. 61/105,412, filed on Oct. 14, 2008, entitled "High Dynamic Range Display with Rear Modulator Control," by Lewis A. Johnson, et al., the contents of which are hereby incorporated by reference in its entirety and for all purposes. Further to the example shown, the data representing drive levels along path 121 facilitate generation of light patterns with the colors red, green, and blue. As indicated by solid paths 122-124, red light patterns 135, green light patterns 136, and blue light patterns 137 are respectively provided to color corrector 130, which in turn, produces rear modulator drive levels (i.e., compensation rear modulator drive levels) for certain colors via dotted paths 131-133. In some examples, red light patterns 135, green light patterns 136, and blue light patterns 137 represent models of back light (e.g., simulated back light) composed of data representing such light patterns. In various embodiments, rear modulator 150 is controlled by color corrector 130 to enable those certain colors to be modulated for at front modulator 160 without color errors. Dials 144 are illustrative of the function of color corrector 130 to adjust the drive levels (i.e., as signals along paths 141-143, respectively) for colors, red (R), green (G), and/or blue (B) so that rear modulator 150 emits light patterns that enable front modulator 160 to modulate the colors without color errors. Note that the positions of front modulator 160 and filter 170 can be interchanged, according to some embodiments.

In FIG. 1B, diagram 101 depicts that color corrector 130 can include a compensator 140 and a translator 150. Color corrector 130 operates to provide control signals to control rear modulator 150 as a function of input images 104 to generate displayable images 180. As shown, synthesizer 120 is coupled to translator 150, and input images 104 are provided to compensator 140 and to synthesizer 120, the latter of which provides estimated drive levels (e.g., for the front modulator) to translator 150. Input images 104 are also provided to pipeline 110, which is coupled to front modulator generator 111. Front modulator generator 111 produces control signals that operate front modulator 160. Examples of techniques to operate front modulator 160 may be found in U.S. Provisional Patent Application No. 61/105,419, filed on Oct. 14, 2008, entitled "Backlight Simulation at Reduced Resolutions to Determine Spatial Modulation of Light of High Dynamic Range Images," by Lewis A. Johnson, the contents of which are hereby incorporated by reference in its entirety and for all purposes.

According to some embodiments, estimated drive levels are configured to cause the front modulator 160 to generate higher-resolution sub-images for certain colors that are prioritized as most important and without color errors (e.g., without perceptible color errors) as defined herein. Exemplary color prioritization techniques for generating a most important color may be found in U.S. Patent Application Publication No. US 2008/0186344 A1, filed on Dec. 23, 2005, entitled "Field Sequential Display of Color Images," by Helge Seetzen, the contents of which are hereby incorporated by reference in its entirety and for all purposes. In some examples, compensator 140 performs color prioritization locally so that a color with the lowest priority may not be suppressed disproportionately by front modulator 160 in portions of an input image where such color is important. In some embodiments, a color importance map is used in determining color priority. Translator 150 performs a combination function to initial and compensated sub-images having corresponding drive levels so as to form rear modulator drive levels with color correction being performed at front modulator 160 when a pixel mosaic is operable. In some embodiments, a color hierarchical convex combination is used as the combination function. Translator 150 generates effective rear modulator drive levels that reduce the effects of adjacent modulating elements 152 of having to compete for the color that best represents the color indicated by the input image, and to mitigate color pollution artifacts. As used herein, the term "competing colors" can refer to, at least in some embodiments, to the colors of light patterns that are competing for transmission via a color element (e.g., filter) configured to transmit multiple colors of the light patterns. Further, color pollution artifacts occur when adjacent modulating elements 152 are configured to modulate for different colors, but color filters associated with the adjacent modulating elements 152 are configured to transmit both of the different colors. Thus, light patterns with different colors (i.e., competing colors) incident on adjacent modulating elements 152 may pollute the modulating elements that are configured to modulate one of the colors. As used herein, the term "color error" can refer, at least in some embodiments, to deviations (e.g., perceptibly deviations) of color with respect to either an expected color, such as for a pixel in an input image, or a neighboring pixel that is configured to provide a color that matches (e.g., perceptibly matches) an expected color that, for example, corresponds to a pixel in an input image. Color errors may arise at or adjacent to interfaces between different colors or luminance values, or both. For example, consider a cyan-colored region abutting a magenta-colored region. In the cyan region, the color blue is the MIC over red, and in the magenta region, the color red is the MIC (red is more important than blue in magenta due to, for example, the photopic response ratios).

Further to this example, the image display system of FIG. 1A is configured to find a compromise between an amount of red that is needed in the magenta area and an amount of red that is not needed in the cyan area to thereby reduce or eliminate color errors in which there is too much red at the interface of the cyan area and too little red in the magenta area.

In view of the foregoing, non-standard pixel mosaics represented by filter 170, and including a two-color sub-pixel mosaic, by way of example, can be used to synthesize three primary colors, such as red, green and blue, thereby enabling the displayable image to have enhanced image quality with relatively fewer components than would otherwise be the case. Further, front modulator 160 can be configured to produce a higher resolution sub-image having a luminance in the form of a light pattern with relatively higher contrast ratio than a contrast ratio associated with low resolution light pattern produced by the rear modulator. In at least some embodiments, the light patterns of the rear and front modulators are used to determine a displayable image 180 of high dynamic range, the displayable image being produced as a multiplicative-combination (i.e., product) of the contrast ratios associated with the light patterns from the rear and front modulators. At a minimum, the displayable image 180 can have a contrast ratio with dynamic range that exceeds each of the individual contrast ratios of the light patterns from the rear and front modulators. A non-standard sub-pixel mosaic also serves to achieve transmission efficiency and resolution gains over those that would otherwise be the case. By providing effective rear modulator drive levels that incorporates color correction, color pollution due to pixels 162 being affected by different light pattern colors (e.g., represented by the point spread functions of adjacent modulating elements) may be reduced or avoided when pixels 162 are not configured to modulate free from color errors. By enabling local determination of color prioritization, artifact mitigation may be achieved in the nature of avoiding the color(s) not identified as the highest priority being suppressed disproportionately by the front modulator in portions of a higher-resolution sub-image where such color is important. In some examples, a rear modulator having both a locally active full color (RGB) array of modulating elements, such as LEDs, and filter 170 composed of a plurality of two sub-pixel elements (e.g., a magenta and green mosaic) facilitates generation of full color display images without temporal field switching of the rear modulator, thereby avoiding color breakup and flicker, than would otherwise be the case. In some other examples, temporal switching of the rear modulator is implemented using a non-standard pixel mosaic that also reduces flicker and color break-up, as well as luminance differences between frames. In particular, full color display images are generated with fewer temporal frames than otherwise might be the case (e.g., switching of three temporal fields).

Figure 2A:
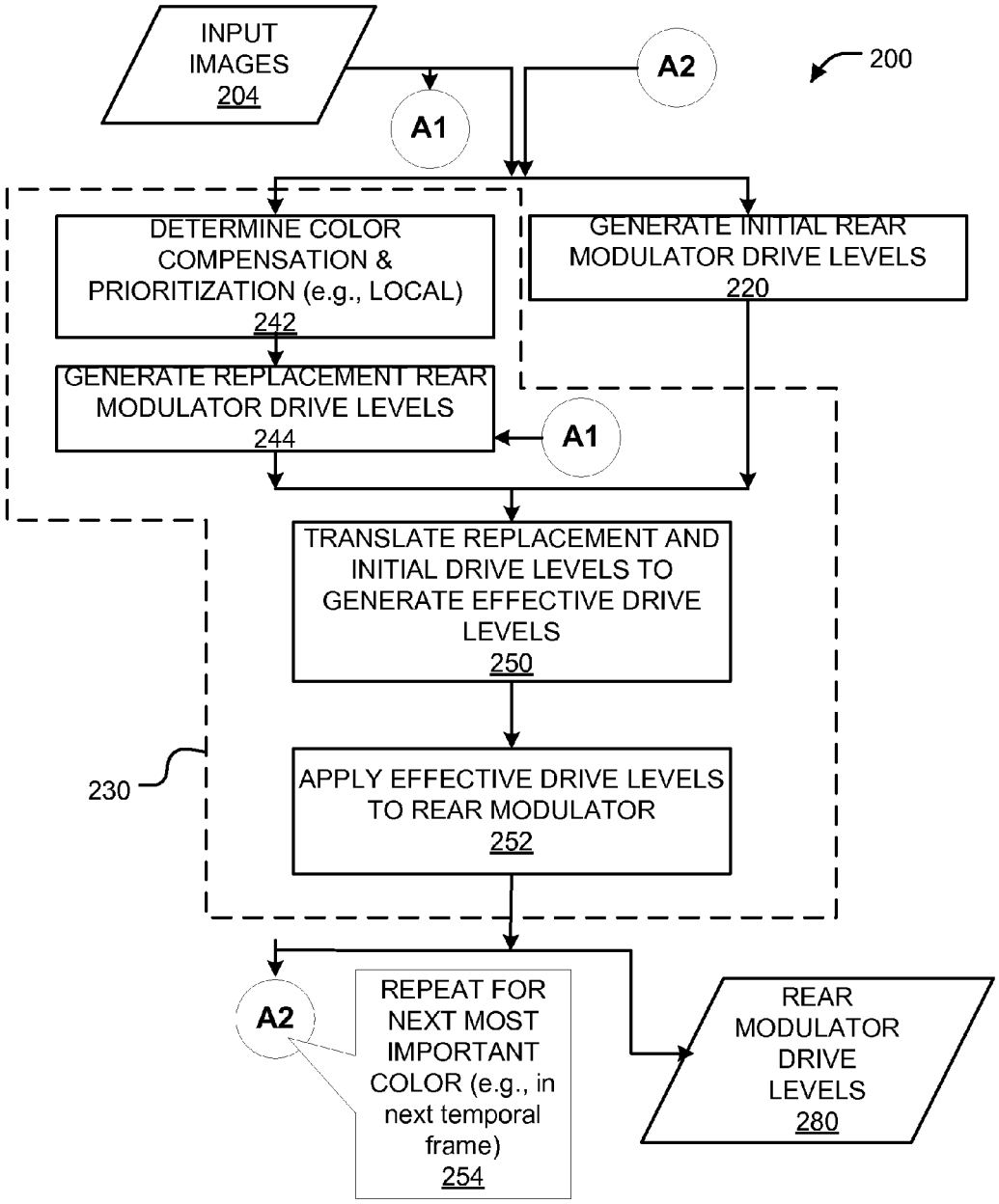
FIGS. 2A-2B illustrate flowcharts representing examples of operating a rear modulator, according to at least some embodiments of the invention.
Figure 2B:
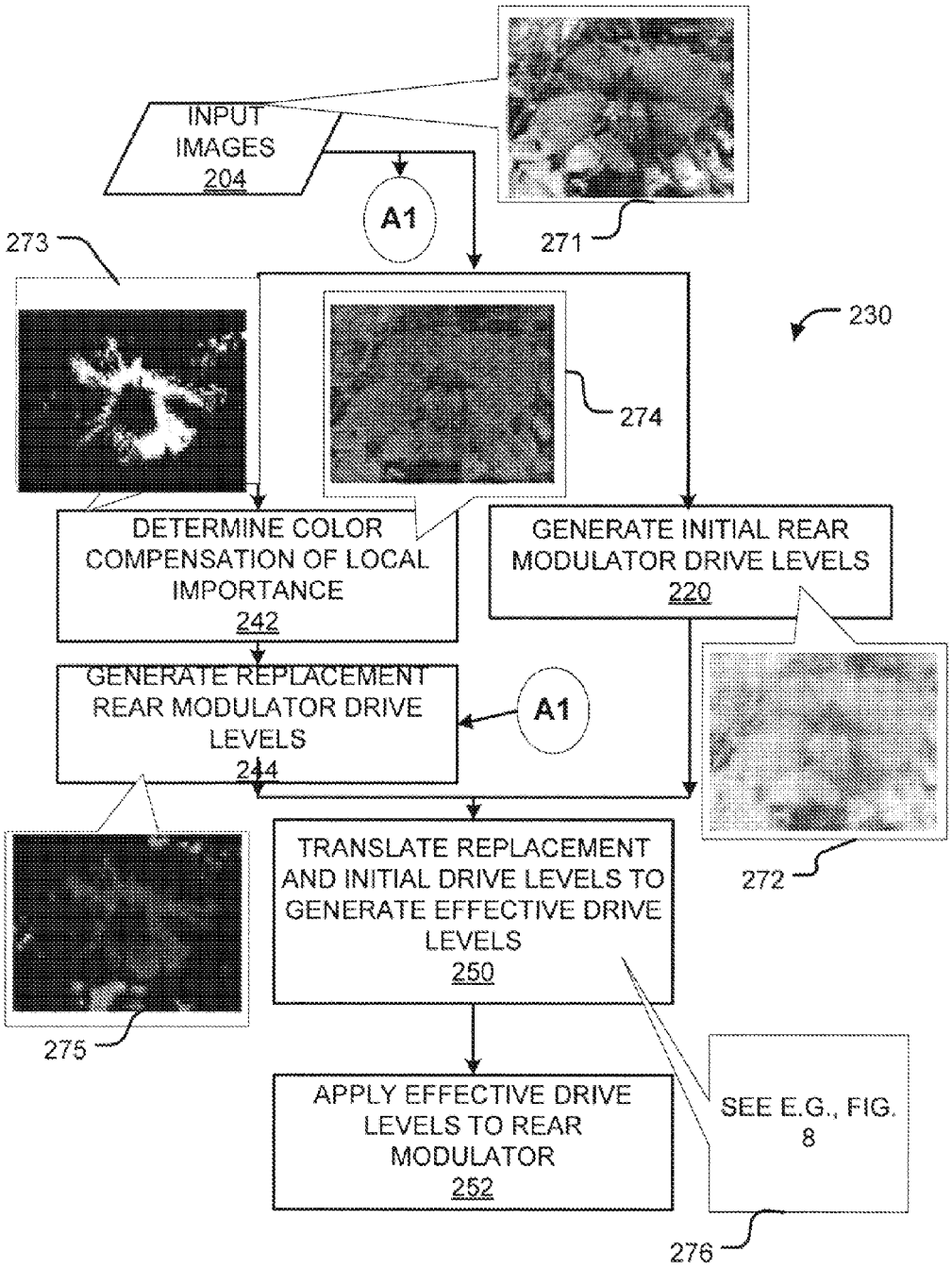

FIGS. 2A-2B illustrate flowcharts representing examples of operating a rear modulator, according to at least some embodiments of the invention. In the examples shown in FIG. 2A, flowchart 200 depicts that input images 204 is provided to block 220 and to block 230. In some embodiments, block 230 represents the functionality of a color corrector, as shown in a dotted line. Block 220 provides the functionality of generating initial sub-images having initial rear modulator drive levels, which are based upon full color control of the front modulator. The initial rear modulator drive levels may be determined in number of ways, including, by way of examples, those techniques described in U.S. Provisional Patent Application No. 61/105,412, entitled "High Dynamic Range Display with Rear Modulator Control," the contents of which are hereby incorporated by reference in its entirety and for all purposes. Additionally, the rear modulator drive levels may further be determined in accordance with field sequential techniques as disclosed in U.S. Patent Application Publication No. US 2008/0186344 A1 entitled "Field Sequential Display of Color Images," the contents of which are hereby incorporated by reference in its entirety and for all purposes. In some examples, block 220 generates, from input images 204, initial rear modulator drive levels that enable the front modulator to provide color control without color errors (or reduced color errors) for a most important color. In at least one example, block 220 or subsequent blocks can control color errors for other colors that are not prioritized as the most important color. Note that color control may be based on either local or global most important color prioritization.

Further to the example set forth in FIG. 2A, block 242 determines color compensation and prioritization. As shown, block 242 receives input images 204, and together with block 244, generates replacement rear modulator drive levels that may compensate for those colors that might be incorrectly provided for by the front modulator in accordance with the description for block 220. Note that the term "replacement" may be used interchangeably with the term "target." In some examples, block 242 uses a color importance map (CIM) that locally prioritizes the color or colors (referred to as color(s)) that are to be modulated at the front modulator without color errors (or with reduced color errors). In some embodiments, a CIM includes binary representations of color(s) that are most important and of color(s) that are not most important. In at least one example, a CIM includes a matrix of data positions that specify whether a pixel (or sub-pixel) is associated with a color that either is an MIC or is not an MIC. A "zero" at a data position can indicate that a pixel (or sub-pixel) is associated with a color that is prioritized as a MIC, where a "one" can indicate an association with a non-MIC (i.e., not prioritized as a MIC). Thus, a CIM can identify the areas and sub-pixels of the front modulator that are being correctly modulated for the most important color(s), as well as the areas and sub-pixels that are not necessarily correctly modulated for the other colors. An image display system then uses the CIM to determine appropriate degrees of compensation to be made on the generation of light patterns by the backlight modulator so that the front modulator modulates without color errors for those color(s) identified as having a possible color error as described with respect to block 220. Note that in some examples, a binary representation of one or more colors prioritized as a MIC can be depicted graphically as white portions of an image to indicate a binary number of "1," whereas a binary representation of the one or more colors that not prioritized as a MIC can be depicted graphically as black portions to indicate a binary number of "0." In other embodiments, a CIM need not be limited to representing zeroes and ones and can include any range of numbers that describe a priority ranking.

Block 242 may be further configured to generate estimated front modulator drive levels configured to form an estimated light patterns having luminance intensity profile $L_{estimated}$, which can be referred to as "an LCD image." The LCD image may be a higher-resolution sub-image generated by a front modulator in response to front modulation drive levels. Some front modulation drive levels are used to modulate "certain color(s)" prioritized as being a most important color without color errors. Other front modulation drive levels are used to modulate other "certain color(s)" that are not prioritized as the most important color without color errors. In some examples, the LCD image is determined without color errors for N color(s) in an image display system with a pixel mosaic (e.g., 2 sub-pixel elements), where N is an integer. In other examples, the LCD image is generated to be indicative of locally determined color(s) which the front modulator can modulate without color errors based on color prioritization techniques. In examples where a color space of three colors are utilized (RGB), effective rear modulator drive levels may be determined to enable 3-N color(s) to be modulated by the front modulator without color errors (or reduced color errors) when a pixel mosaic is operable.

Block 244 may be configured to generate replacement rear modulator drive levels that are indicative of desired drive levels (e.g., backlight). These drive levels control modulating elements 152 so that they illuminate front modulator 160 in a manner that reproduces the input image without color errors for a certain color. In some examples, the follow equation, Eq. (1), is used:

$$L_{Target}=L_{input}/L_{estimated}, \quad \text{Eq.(1)}$$

where $L_{Target}$ represents luminance intensity profiles corresponding to replacement rear modulator drive levels that are operable to form a rear modulator sub-image. $L_{input}$ represents the input luminance profiles derived from input image 204 via path A1, and $L_{estimated}$ refers to the LCD image as described above. In some examples, Eq. (1) describes the generation of a replacement sub-image by dividing the input image by the estimated sub-image. From Eq. (1), replacement rear modulator drive levels can be generated to represent the color-corrected backlight so pixels at the front modulator to modulate without color errors for such colors (where the pixels might otherwise modulate with color errors for some colors in block 220). In some examples, a target backlight may be modeled mathematically for purposes of predicting backlight that provides for color correction.

A determination is then made to select which pixels are to be controlled by using: (1) a rear modulator light field generated where the front modulator has full color control and modulates without color errors for some colors but not for others (as per block 220); (2) a rear modulator light field having color correction (e.g., as per block 244); and/or (3) some combination of (1) and (2).

Block 250 may be configured to make this determination. In at least some examples, block 250 translates the initial sub-images with corresponding initial rear modulator drive levels (determined from block 220) and the replacement sub-images with corresponding replacement rear modulator drive levels (determined from block 244) into effective rear modulator drive levels. With this translation, local color importance determination relies upon a combination of two images: one being a set of backlight drive levels being generated based on the original image (e.g., initial rear modulator drive levels from block 220); and the other being a set of backlight drive levels generated based on the replacement backlight image (in block 244), which is due to the lack of full color control of the front modulator when the pixel mosaic is operable. In various embodiments, there are a variety of suitable combination functions to achieve effective rear modulator drive levels. In some examples, an average value is used. In other examples, a weighted-combination function is used. As the effective rear modulator drive levels are representative of modified RGB control signals, these rear modulator drive level signals may be analogized to the adjustability depicted by dials 144 in FIG. 1A.

Block 252 is configured to apply the effective rear modulator drive levels 280 to operate the rear modulator 150, according to some embodiments. In doing so, the effective rear modulator drive levels are determined for a color for which the front modulator otherwise does not modulate without color errors in block 220, but can be modulated without color errors with block 252 in accordance with various embodiments. Path direction A2, as indicated by callout 254, illustrates that in a next temporal frame, color compensation may be performed for the next most important color, in some examples. In other examples, path direction A2 may refer to an iterative function for different colors in subsequent temporal frames. In yet other examples, path direction A2 may refer to an iterative function to account for color errors in subsequent temporal frames.

According to various embodiments, flowchart 200 describes the functionality for operating a rear modulator using the combination of three-dimensional color synthesis techniques with field sequential color synthesis techniques. In doing so, the effective drive levels are generated to replace initial rear modulator drive levels determined by block 220 so as to provide color correction when a pixel mosaic represented by filter 170 is used. Blocks 242 and 244 function, in some examples, to ascertain what the rear modulator drive levels that may enable the front modulator to operate without color errors discussed in the context of block 220.

FIG. 2B depicts examples of color correction block 230 of FIG. 2A. In situations where the front modulator performs three-dimensional color synthesis with a pixel mosaic, and where full color control is not available at the front modulator, the sub-image generated by the front modulator might have color errors for some colors, but not for others. And for these color errors, the drive levels may be determined so that the rear modulator illuminates the front modulator without color errors for certain color or colors. In the examples implementing the flow of FIG. 2B, input image 204 is received by block 220. An example of input image 204 is depicted as image 271. Block 220 generates initial rear modulator drive levels to generate a sub-image, such as sub-image 272. In this example, sub-image 272 has yellow (i.e., red and green) as the color being modulated for without color errors, and having blue with color errors.

Further to the example shown, block 242 receives input image 204 and generates a color importance map 273. In example shown, consider that when blue is the MIC with respect to block 242, the white portions of CIM 273 specify first portions of CIM 273 where blue should be modulated without color errors, whereas the black portions of CIM 273 specify second portions of CIM 273 where yellow should be modulated (i.e., did not have color errors to begin with in block 220) as blue is not the most important color in the second portions. Block 242 further determines an estimated light pattern indicative of the higher-resolution sub-image that may be displayed by the front modulator, as indicated by the callout depicting sub-image 274. Sub-image 274 may be generated by using sets of front modulator drive levels for the color blue in those first portions where blue is prioritized as the most important color (to compensate for color errors). Also, sub-image 274 may be generated by using sets of front modulator drive levels for the color yellow in those second portions where blue is not prioritized as the most important color.

Block 244 generates a replacement sub-image 275 associated with replacement rear modulator drive levels of yellow color, as determined by Eq. (1). In some examples, block 244 determines that where blue is prioritized as the most important color. Thus, rear modulator drive levels may be selected such that the color blue is modulated at the front modulator without color errors in areas of an image where blue is the most important color, otherwise, rear modulator drive levels may be selected such that the color yellow may be modulated at the front modulator in areas where blue is not the most important color. Block 250 translates the drive levels of sub-images 272 and 275 to effective drive levels. In some examples, and as callout 276 indicates, techniques described in FIG. 8 may be utilized.

Figure 3:
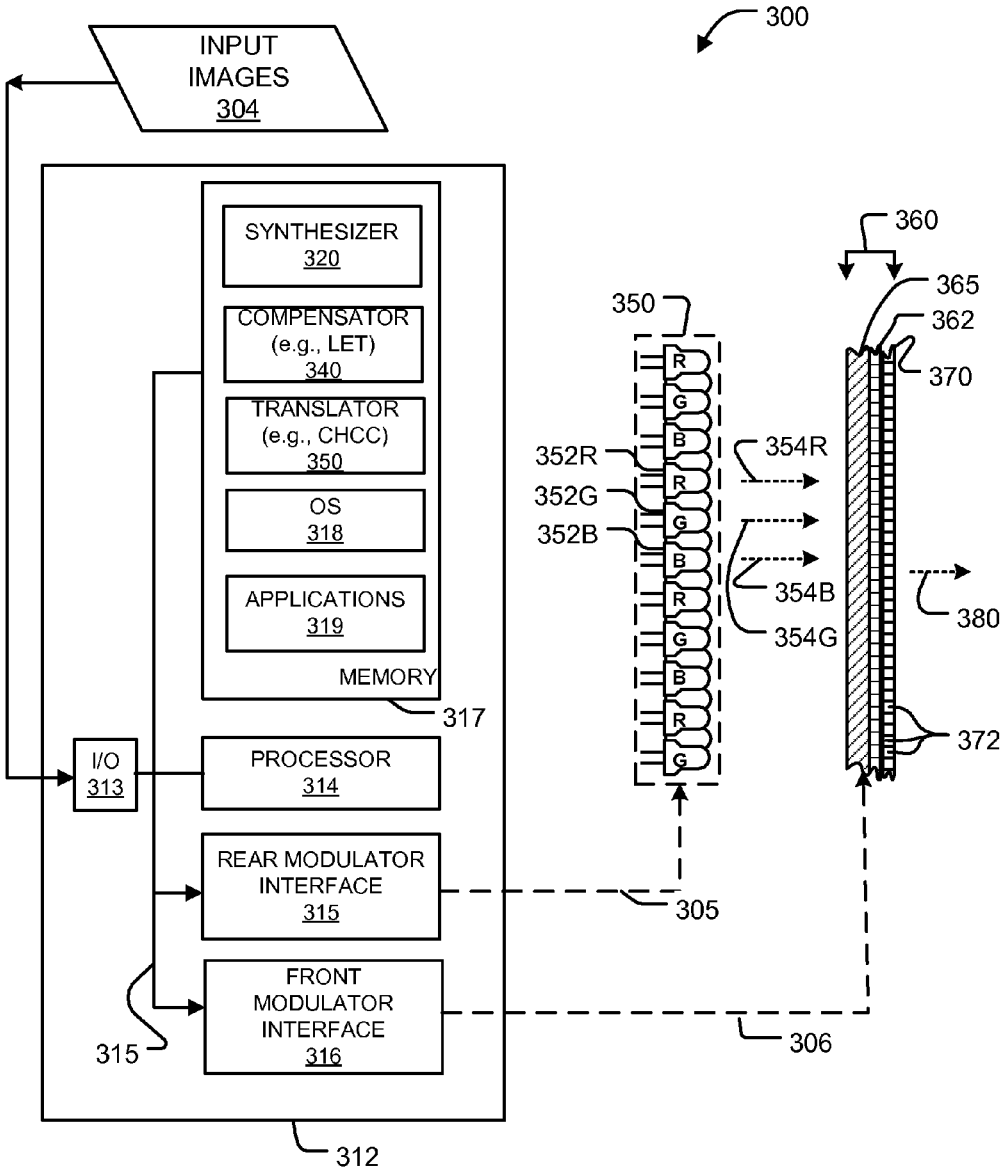
FIG. 3 is a schematic diagram of a controller configured to operate an image display system, according to at least some embodiments of the invention.

FIG. 3 is a schematic diagram of a controller configured to operate an image display system, according to at least some embodiments of the invention. In the example shown, image display system 300 includes a controller 312 coupled to rear modulator 350 and front modulator 360. Controller 312 includes an input/output (I/O) module 313 configured to receive input images 304, a processor 314, a rear modulator interface 315 configured to control rear modulator 350, a front modulator interface 316 configured to control front modulator 360, and a memory 317. Bus 315 couple these modules and the components of controller 312 to each other. Processor 314 is configured to receive input images 304. In some examples, input images 304 may be gamma-encoded video signals (e.g., video stream), from which image pixels are derived. In other examples, input images 304 are scaled suitably for color balance based upon certain techniques of three-dimensional color synthesis utilized. Memory 317 can include a synthesizer module 320, a compensator module 340, a translator module 350, an operating system 318, and ancillary applications 319 used to facilitate operation of controller 312, as well as more or fewer modules than shown.

Rear modulator 350 can be configured to be a light source to illuminate front modulator 360. In some examples, rear modulator 350 can be formed from one or more modulating elements 352R, 352G, and 352B, such as an array of LEDs, or one or more light sources. When controlled, either individually or in groups, modulating elements 352R, 352G, and 352B emit light fields composed of various colors, respectively 354R, 354G, and 354B, along an optical path to illuminate front modulator 360.

Front modulator 360 may be an optical filter of programmable transparency that adjusts the transmissivity of the intensity of light incident upon it from the rear modulator 350. In some examples, front modulator 360 includes an LCD panel or other transmission-type light modulator having pixels. In other examples, front modulator 360 includes: optical structures 365; a liquid crystal layer with pixels 362; and, color elements 370. Optical structures 365 are configured to carry light from rear modulator 350 to the liquid crystal layer having pixels 362, and include elements such as, but not limited to, open space, light diffusers, collimators, and the like. Filter 370 includes an array of color elements 372, which, in some examples, has a plurality of sub-pixel elements. Front modulator 360 can have a resolution that is higher than the resolution of rear modulator 350. In some examples, front modulator 360 and rear modulator 350 are configured to collectively operate image display system 300 as a HDR display.

Based upon input image 304, controller 312 is configured to provide via interface 315 over path 305 rear modulator drive levels (e.g., signals) to control modulating elements, such as 352R, 352G and 352B of rear modulator 350. Controller 312 also is configured to provide via interface 316 over path 306 front modulator drive signals to control pixels 362 and sub-pixels (e.g., 474, 475, 476 and/or some combination of these as may be described in FIG. 4A) of front modulator 360, thereby collectively producing displayable images 380.

Synthesizer module 320 is configured to generate rear modulator drive levels along path 305 based on input images 304, according to some embodiments. Compensator module 340 is configured to enable color prioritization to be determined locally so that a color with the lowest priority is not be suppressed disproportionately by the front modulator 360 in portions of an image where such color is important. Translator module 350 is configured to enable the generation of effective rear modulator drive levels so that pixels 362 that are illuminated by different colors emitted by adjacent modulating elements 352 may compete (i.e., be controlled to select alternatives) for the color that substantially represents the color indicated by the input image.

Although not shown, controller 312 may be coupled to a suitably programmed computer having software and/or hardware interfaces for controlling rear modulator 350 and front modulator 360 to produce displayable (HDR) images 380. Note that any of the elements described in FIG. 3 may be implemented in hardware, software, or a combination of these.

Figure 4A:
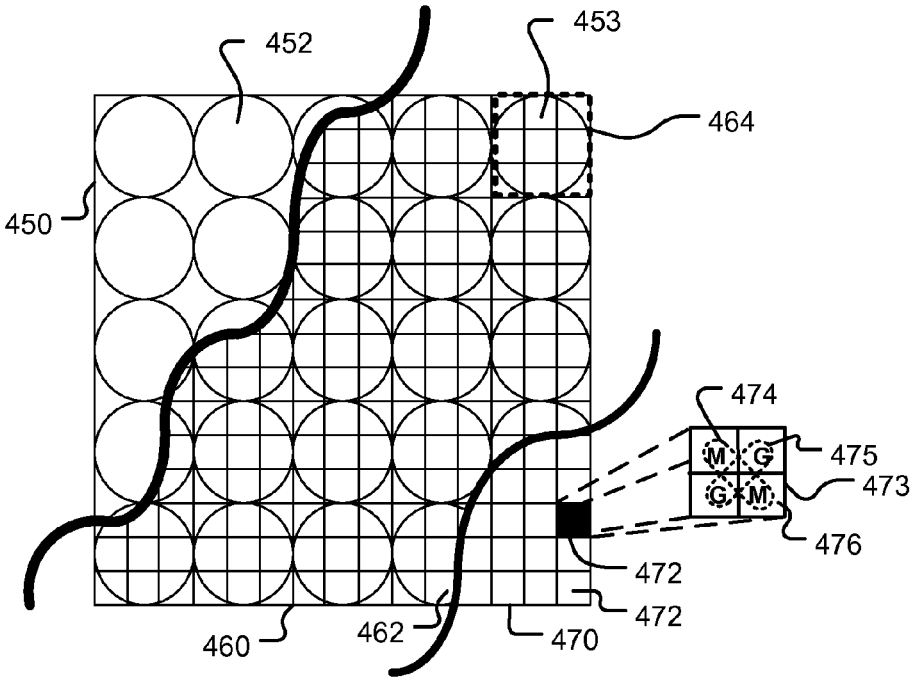
FIGS. 4A-4B illustrate diagrams of exemplary rear and front modulator components, according to at least some embodiments of the invention.
Figure 4B:
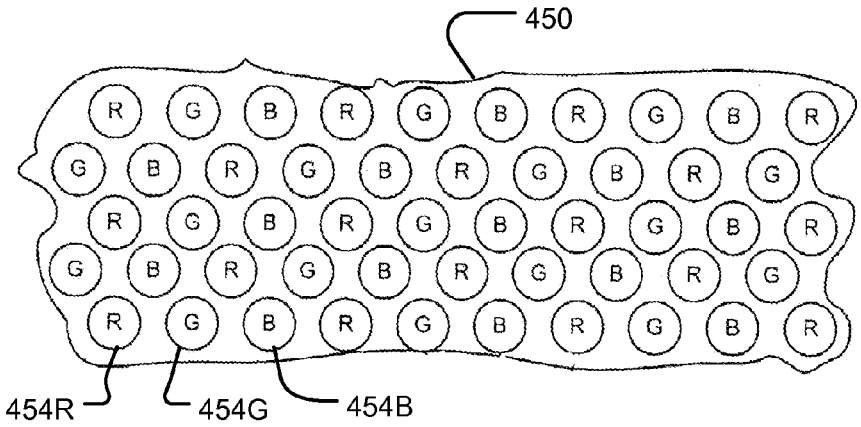

FIGS. 4A-4B are diagrams of exemplary rear and front modulator components, according to at least some embodiments of the invention. In the examples shown in FIG. 4A, rear modulator 450 includes a plurality of modulating elements 452, and front modulator 460 includes a plurality of pixels 462. Further, a single modulating element 453 is disposed behind several pixels (in dotted box 464) of front modulator 450. In other examples, there may be a plurality of modulating elements 452 that illuminate a plurality of pixels 462 with red, green and blue colors. Additionally, filter 470 is disposed along an optical path of front modulator 460 and includes a plurality of color elements 472. Pixels 462 and color elements 472 may be of similar or different resolution.

Color element 472, shown as callout 473, includes two sub-pixel elements, such as sub-pixel element 474 and sub-pixel element 475, either or both of which may provide for color synthesis control in some examples. In other examples, each of the 4 sub-pixels 476 is individually controlled to provide color synthesis control of color element 472. In examples where pixel 462 and color element 472 are of similar resolution, control of sub-pixel elements 474-475, sub-pixels 476, and/or some combination of such may be undertaken in a manner in which to control a corresponding pixel 462. In examples to effectuate individual control of sub-pixels 476, a front modulator 460 includes sub-pixels (not shown) that may be configurable to transmit a portion of the light patterns through corresponding filter 470 and sub-pixels 474, 475, 476, or some combination of such. In yet further examples, sub-pixel elements 474 and 475 can be described as first and second subsets of sub-pixel color filters. While magenta (M) and green (G) are used in this example for sub-pixel elements 474 and 475, respectively, other pairs of colors for color element 472 are possible. For example, a two sub-pixel element can be selected as a color pair from a group comprising magenta-green, cyan-magenta, cyan-yellow, blue-yellow, magenta-yellow, and red-cyan. For further details of three-dimensional color synthesis techniques and color additive techniques, reference is made to U.S. Provisional Patent Application No. 60/667,506, filed on Apr. 1, 2005, entitled "Three-Dimensional Color Synthesis for Enhanced Display Image Quality" by Silverstein, et al., the contents of which are hereby incorporated by reference in its entirety and for all purposes.

FIG. 4B illustrates an example of a rear modulator having an arrangement of modulating elements in an array 450. In this example, modulating elements 454 are light sources such as LEDs, and array 450 is configured with either a symmetrical or asymmetrical arrangement of modulating elements 454 to illuminate active portions of a front modulator with light emitted from any one of the colors for which there are light sources. For example, modulating elements 454 include red color modulating element 454R, green color modulating element 454G, and blue color modulating element 454B. In some examples, the point spread functions of adjacent modulating elements 454 of each (RGB) color overlap with one another. Modulating elements 454 of different colors in different portions of array 450 can be independently controlled.

The image processing techniques described herein incorporate color synthesis techniques so that displayable images may effectuate a certain perceptual experience for a viewer, as intended by the content of the input images, but with consideration of the human visual system and associated limitations of spatial and temporal resolution processing capability. For example, imperfections in the media of the human eye may cause light to scatter within the eye and to form a veiling luminance on the retina, which reduces the ability to perceive certain contrast. Thus, the human eye may not be able to integrate and perceive resolutions beyond a certain threshold. In at least some embodiments where three dimensional color synthesis techniques are described herein, a filter having color elements composed of two sub-pixel elements (also referred to as a pixel mosaic, or mosaic) may be illuminated with at least two spectral power distributions by a rear modulator. In some examples, sub-pixel elements 474, 475, and/or sub-pixels 476 are controlled individually or as a subset of sub-pixels so as to effectuate additive color mixing techniques, and are illuminated with the sub-images described herein to enable the displayable images to be perceived with a uniform field of color that is a combination of colors that when mixed (e.g., combined spatially) may be perceived as an intended uniform color. Additionally, a mosaic of two sub-pixel elements illuminated with a full color capable rear modulator that can produce at least two spectral power distributions may reproduce two colors of a three-color color-space (e.g., R, G and B) everywhere in an image in the same temporal frame. In at least some embodiments where field sequential color synthesis techniques are described herein, replacement rear modulator drive levels may be generated that approximately and substantially causes reproduction (or display) of a certain color by the front modulator without color errors when a pixel mosaic is operable. The rear modulator color correction (i.e., compensation) technique used in combination with the two sub-pixel elements effectuating three dimensional color synthesis processing, may enable a third color of a three-color color space to be approximately reproduced and with minimal visual artifacts. By illuminating certain pixels with a certain spectral power distribution, a set of red, green or blue primary colors can be produced. Some examples of dual spectral power distributions may include, but are not limited to, pairs of colors that may be effectuated by modulating elements comprising cyan/yellow, blue/yellow, green/magenta, cyan/magenta, red/cyan, and magenta/yellow.

Figure 5A:
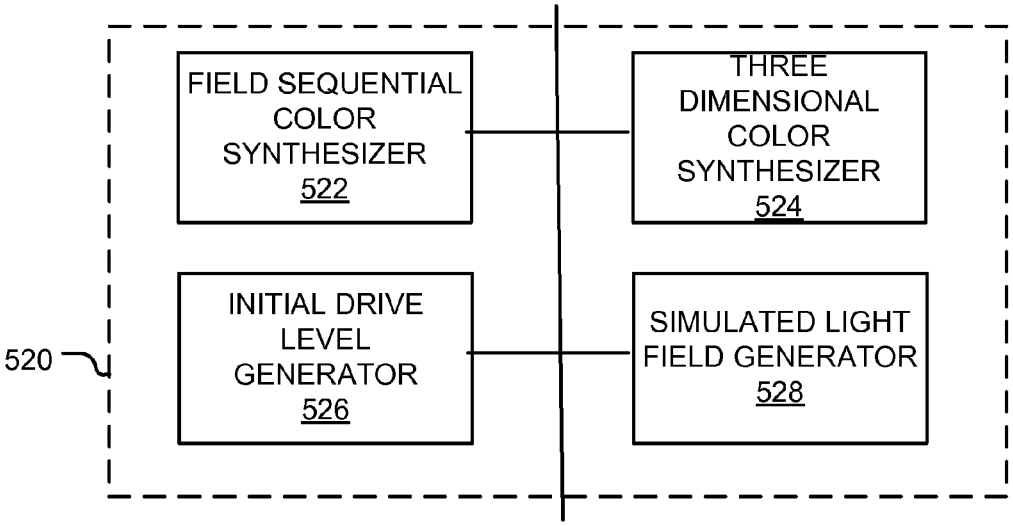
FIGS. 5A-5C illustrate functional block diagrams of examples of a synthesizer, a compensator and a translator, according to at least some embodiments of the invention.
Figure 5B:
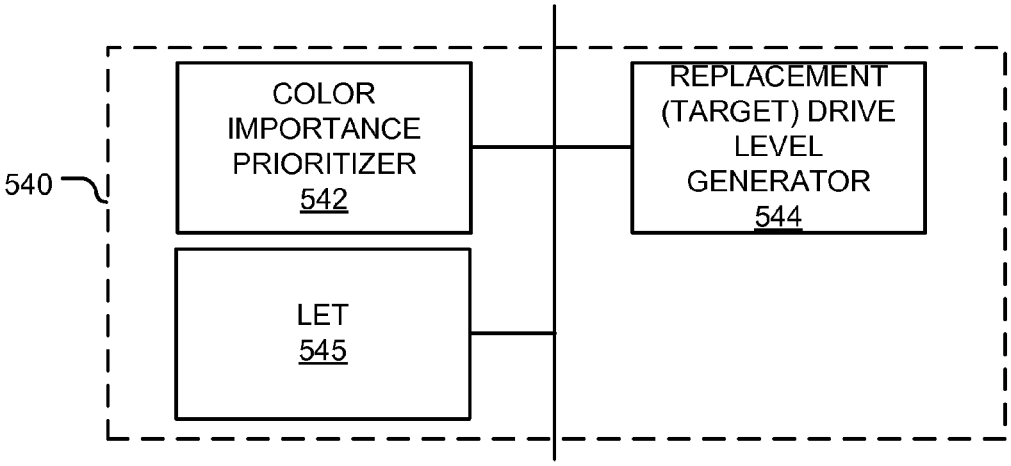
Figure 5C:
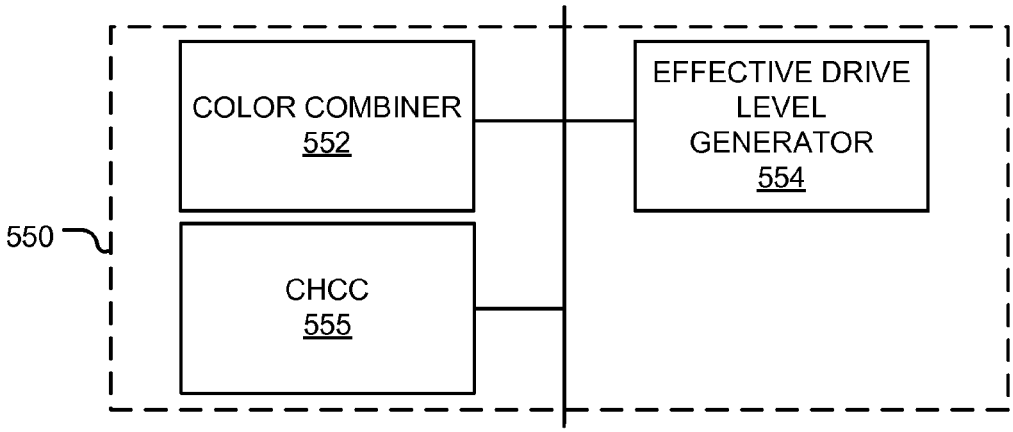

FIGS. 5A-5C illustrate functional block diagrams of examples of a synthesizer, a compensator and a translator, according to at least some embodiments of the invention. In the example shown in FIG. 5A, synthesizer 520 includes a field sequential color synthesizer module 522, a three-dimensional color synthesizer module 524, an initial drive level generator 526, and a simulated light field generator 528. Field sequential color synthesizer module 522 is configured to produce perceptually full color images using different temporal frames in rapid sequence, and is configured to implement the techniques disclosed, for example, in the U.S. Patent Application Publication No. US 2008/0186344 A1, entitled "Field Sequential Display of Color Images," the contents of which are hereby incorporated by reference in its entirety and for all purposes. Three-dimensional color synthesizer module 524 may be configured to enable production of full color images using non-standard pixel mosaics and rear modulators (e.g., backlights), and may be configured to enable the techniques disclosed, for example, in U.S. Provisional Patent Application No. 60/667,506, filed on Apr. 1, 2005, entitled "Three-Dimensional Color Synthesis for Enhanced Display Image Quality," the contents of which are hereby incorporated by reference in its entirety and for all purposes. Initial drive level generator 526 may be configured to determine rear modulator drive levels derived from the input image and can be configured to reproduce the input image on the front modulator that is capable of full color control. Simulated light field generator 528 provides a prediction or estimate of the light field to be projected by the rear modulator onto the front modulator, and implements the techniques disclosed, for example, in U.S. Provisional Patent Application No. 61/105,412, filed on Oct. 14, 2008, entitled "High Dynamic Range Display with Rear Modulator Control," the contents of which are hereby incorporated by reference in its entirety and for all purposes.

Compensator 540 includes a color importance prioritizer 542, a replacement (target) drive level generator 544, and a low end threshold (LET) module 545. In at least one embodiments, color importance prioritizer 542 determines the color priority or color prioritization of an image or part of an image, and ranks colors in priority, as well as determining which color or colors may be perceptually the most important to reproduce an input image without color errors. In some examples, color importance prioritizer 542 determines color compensation based on local importance of certain color(s) in some examples, and based on global importance of color(s) in other examples. Prioritizer 542 generates a color importance map and an LCD image, both of which are described herein. Replacement drive level generator 544 may be configured to determine desired drive levels (e.g., for the rear modulator, or backlight in some examples) so that modulating elements (e.g., 152) illuminate front modulator (e.g. 160) to recreate the input image with luminance as close as possible and without color errors when a pixel mosaic is operable. In some examples, generator 544 implements the technique as described with respect to Eq. (1), where drive levels are generated that may compensate for color(s) provided in error by the front modulator in accordance with the description for block 220. LET module 545 may be configured to enable the functions described with respect to FIG. 9.

Translator 550 includes a color combiner 552, an effective drive level generator 554, and a color hierarchical convex combination (CHCC) module 555, according to some embodiments. Color combiner 552 provides suitable combination functions to be applied to the initial and replacement drive levels. Because a plurality of pixels may be illuminated by a modulating element, some areas of the front modulator affected by a certain modulating element may have some pixels that modulate with color errors for certain color(s) and some that modulate without color errors for different color(s). Accordingly, a combination function may be used to combine the rear modulator light field (based on having full color control of the front modulator for a color) and a rear modulator light field (generated based on color compensation) to account for regions in which there is a mixture of both situations at the front modulator. In some examples, the combination function is an average of the two situations. In other examples, the combination function constitutes a color hierarchical convex combination of Eq. (2). Effective drive level generator 554 may be configured to use a combination function of module 552 (or module 555 in some examples) to translate the initial rear modulator drive levels determined from generator 526 with the replacement drive levels determined from generator 544 and with a color importance weight map as described herein into the effective rear modulator drive levels. In doing so, the local color importance determination relies upon drive levels generated based on the target backlight image due to the lack of full color control of the front modulator inherent to the use of the pixel mosaic. CHCC module 555 may be configured to enable the functions described in FIGS. 6-8.

Figure 6:
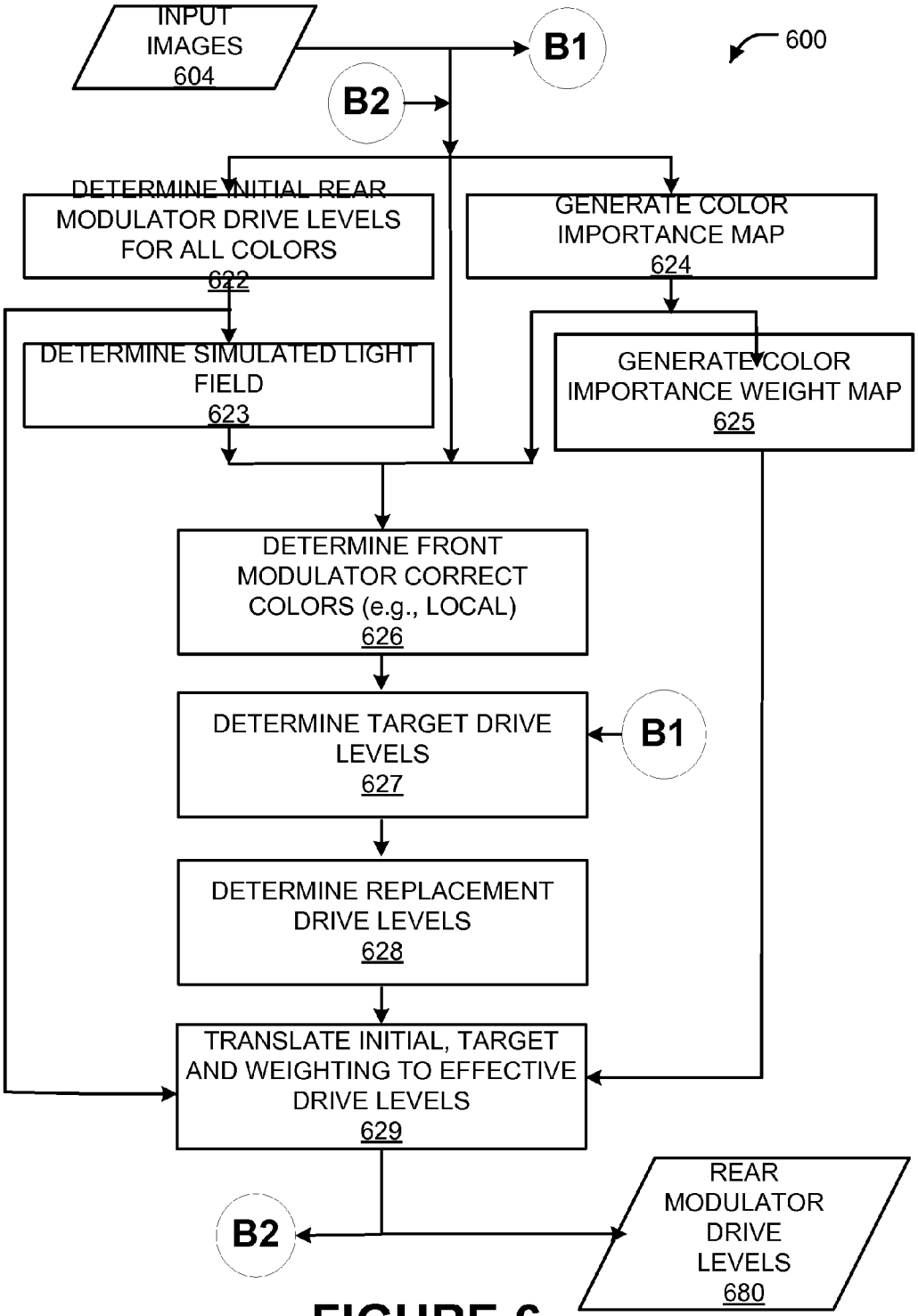
FIG. 6 illustrates a flowchart representing another example of operating a rear modulator, according to at least some embodiments of the invention.

FIG. 6 illustrates a flowchart representing another example of operating a rear modulator, according to at least some embodiments of the invention. In the example shown, flowchart 600 represents a method to determine appropriate rear modulator drive levels to illuminate a front modulator with non-standard pixel mosaics. This method can be described interchangeably as a "color hierarchical convex combination" technique, and facilitates control of modulating elements by determining intermediary drive levels between the replacement drive levels and the initial drive levels previously described in FIGS. 2A-2B. Because the replacement drive levels and the initial drive levels may each cause modulating elements to emit different light fields, at least in some examples, a weighted combination of the two sets of drive levels is determined for deriving effective drive levels.

Flowchart 600 indicates that input images 604 are provided to blocks 622 and block 624. Block 622 provides the functionality of determining initial rear modulator drive levels derived from the input image. Also, block 622 reproduces the input image on the front modulator that is capable of full color control. In some examples, the techniques applicable to block 220 of FIG. 2A may be utilized, as well as the techniques disclosed in U.S. Provisional Patent Application No. 61/105,412, entitled "High Dynamic Range Display with Rear Modulator Control," the contents of which are hereby incorporated by reference in its entirety and for all purposes. In other examples, various techniques may be used to determine initial rear modulator drive levels based upon an assumption that the front modulator is capable of full color control. In some embodiments, "initial rear modulator drive levels" and "initial backlight drive levels" refer to rear modulator drive levels that are determined by block 622 (and block 220 of FIG. 2A). Further, block 622 generates the rear modulator drive levels that relate to areas of an input image where the front modulator is modulating without color errors for a first subset of a plurality of colors, and to areas of the input image where the front modulator is modulating with color errors for a second subset of the plurality of colors when a pixel mosaic is operable.

Block 623 provides the functionality of simulating the rear modulator light field based upon a known point spread function on the front modulator. The light field simulation can be created using a model of the light spread function from one or more modulating elements (e.g., 152, 452). The light field simulation predicts the light field that the rear modulator would project onto the front modulator. In some examples, the simulation scales the intensity of the light spread function by the drive levels corresponding to one or more modulating elements, and takes the summation of these levels. In other examples, the light spread function is compressed to a low resolution matrix that can be stored in memory 317 so as to reduce computational expense. In yet other examples, techniques to simulate the rear modulator light field may also be found in U.S. Provisional Patent Application No. 61/105,419, entitled "Backlight Simulation at Reduced Resolutions to Determine Spatial Modulation of Light of High Dynamic Range Images," the contents of which are hereby incorporated by reference in its entirety and for all purposes.

Block 624 provides local prioritization function of generating an indicator of which color(s) is/are more important and the corresponding location(s) of such color(s) in an image. In some embodiments, a color importance map (CIM) is generated by block 624. In this example, a CIM represents an input image and includes information about the most important color(s) (i.e., color in some examples, or colors in other examples) relative to other color(s) of the input image as previously described. In some examples, a CIM is indicative of a pixel-wise comparison (or mapping) of RGB pixel values based on the application of photopic ratios, wherein the CIM includes weighted comparisons between RGB pixel values. In other examples, a CIM is determined for different areas of the modulator. In yet further examples, factors associated with the human visual system are used to determine a color importance map. An example of such a factor is defining the color green as more important than red, regardless of the pixel values for a given luminance range. Block 624 provides local prioritization of colors based on relative spatial densities of different areas of an image having different color importance, such as by applying a Gaussian filter to a pixel-wise importance map. Depending upon the technique of three-dimensional color synthesis implemented, block 624 may further include functionality to compare all three colors of RGB in terms of importance, or may compare two of the three colors in terms of importance.

In examples where the two-sub-pixel mosaic has a cyan and magenta configuration, block 624 is configured to determine the relative importance of green, red and blue because each color may compete to be represented in the image, due to cyan being composed of blue and green colors and due to magenta being composed of red and green. By contrast, if the two sub-pixel mosaic has a green and magenta configuration, block 624 determines the relative importance of red versus blue because green would be modulated independently from these two colors. In still other examples, and referring back to FIG. 2B, sub-image 273 is determined by a CIM, where the white portions indicate that modulating elements should be controlled for the MIC of blue (i.e., blue is indicated, and where the black portions everywhere else indicate that the modulating elements should be controlled for other colors, namely red and green.

Block 625 can be configured to generate a normalized map that can be used to determine suitable control signals to be applied to drive modulating elements (e.g., 152, 452). In some embodiments, the normalized map associated with the rear modulator is in the form of a color importance weight map ("CIWM"). A CIWM can include an arrangement of data in the form of a histogram to, for example, express the percentage of colors prioritized as a most important color and the percentage of colors most important for other colors that are not prioritized as the most important color. According to some embodiments, a CIWM is determined by, but is not limited to, factors such as: the number of pixels in a given area of the front modulator (i.e., a portion of a sub-image) which may be affected by a certain modulating element, and which may have a certain MIC; and, the number of pixels that may have a different MIC. One implementation of a CIWM includes a histogram based upon the relative frequency of pixels with different MICs, corresponding to certain modulating element(s). In such an implementation, the histogram includes, for each pixel, a weighted parameter indicative of the degree of luminance intensity that a modulating element should be controlled so that the front modulator operates the modulating element without color errors for a particular color. To illustrate, consider that an area of the front modulator has seventy-five pixels that have red as the MIC and twenty-five pixels that do not, the CIWM is scaled towards red for those 100 pixels. In other examples, the CIWM is determined based on the difference between opponent colors, that is, the color contrast for a certain area of the modulator, and factors from the human visual system. In still further examples, if the seventy-five pixels in the previous example had red as marginally more important than a second color, but twenty-five pixels had the second color substantially more important than red, then the CIWM having a representation of a weighted averages of a sub-image may be scaled further towards the second color in the example using the histogram representation.

Block 626 determines which parts of a sub-image for display on the front modulator are modulated without color errors for the most important color MIC (e.g., blue) and for other colors (e.g., red and green) based on the color importance map determined in block 624, the simulated light field determined in block 623, and the input image 604. In some examples, block 626 generates rear modulator drive levels with color correction so that pixels that are configured to modulate a blue color as the MIC without color errors for each pixel, or generates rear modulator drive levels with color correction so that pixels that are configured to modulate red and green colors may be modulated on the front modulator without color errors. Further, block 626 may estimate or predict the front modulator sub-image based on the simulated rear modulator light field, which is configured to produce sub-images without color errors for the MIC in areas of an image (i.e., locally), as determined by the CIM. In some examples, this sub-image corresponds to estimated drive levels for controlling the front modulator so that it modulates based on, for example, the CIM and the input image. The CIM may include data representing a gradual fade from one color to another. In this case, a binary representation of the gradual fade is associated with a cutoff between areas with "0" (e.g., visually represented by black) and areas of "1" (e.g., visually represented by white). To depict a gradual fade, block 626 estimates the front modulator image so that the front modulator can adjustably-control the image to gradually change which color is modulated to produce a gradual fade from one color to another without color errors.

Block 627 can be configured to determine a compensation rear modulator (e.g., backlight) drive level for each color. According to some embodiments, this determination is performed by calculating target rear modulator drive levels colors of back light, such as red, green and blue, as these colors may be compensated for in portions of a sub-image where they are modulated by the front modulator with color errors. In some examples, the input image 604 provided on path B1 is divided by the estimated drive levels determined in block 626 for a certain color (or colors) such as the MIC, thereby producing a higher-resolution sub-image that is reproduced without color errors for a certain color (or colors) for the target rear modulator drive levels.

Block 628 can be configured to provide preconditioning of desired rear modulator drive levels that will most closely reproduce the sub-image determined in block 627 for a certain color. One manner of determining the rear modulator drive levels is to produce or predict a target sub-image based on a point spread function of the rear modulator. Thus, the target sub-image is a blurred representation of the input image. In some examples, block 628 determines the rear modulator drive levels by applying a reverse blur simulation to the target sub-image. A reverse blur simulation can be performed by using a deconvolution technique, such as a Lucy-Richardson deblurring technique. The "unblurred" image then is downsampled for the number of available modulating elements associated with the rear modulator, wherein the resultant rear modulator drive levels are used to control the modulating elements.

Block 629 translates the initial rear modulator drive levels (from block 622), the target drive levels (from blocks 627 and 628) and the color importance weight map (from block 625) to form the effective rear modulator drive levels 680. In some embodiments, the translation uses a combination function to produce the effective rear modulator drive levels 680. In at least one embodiment, a convex combination function constitutes the combination function that uses data representing the initial rear modulator drive level, the target drive level, and the weight map. Block 629 may be configured so that the combination enables the rear modulator to be provided: with drive levels for a certain color as it was originally determined (e.g., as indicated by the color in the input image) in portions where the front modulator could be modulating with color errors for that certain color; with target drive levels to effectuate the color compensation in portions where the front modulator may be modulating without color errors for other colors; and with drive levels representing the weighted combination as previously described. In some examples, a weighted combination of the initial rear modulator drive levels ("A") and the target drive levels ("B") is determined according to Eq. (2).

$$\text{Convex}\ (A,B)=\text{weight}*A+(1-\text{weight})*B \qquad \text{Eq. (2)}$$

Eq. (2) can provide intermediate values for the rear modulator drive levels that are between the initial rear modulator drive levels determined by block 622 and the target drive levels determined by blocks 627-628. In some examples: Convex (A,B) may be represented as effective light patterns ($LP_{effective}$) produced by the effective rear modulator drive levels; A refers to a first image ($Image_1$), which may be the initial sub-image (from blocks 622-623, 220); B refers to a second image ($Image_2$), which may be the replacement sub-image (from blocks 628, 244); and Weight refers to the histogram (from blocks 625, 250). In such examples, Eq. (2) is described as follows: $LP_{effective}=Image_1*Weight+Image_2*(1-Weight)$. In other examples, reference to $LP_{effective}$ refers to rear modulator light patterns configured to be formed from the rear modulator drive levels.

Figure 7A:
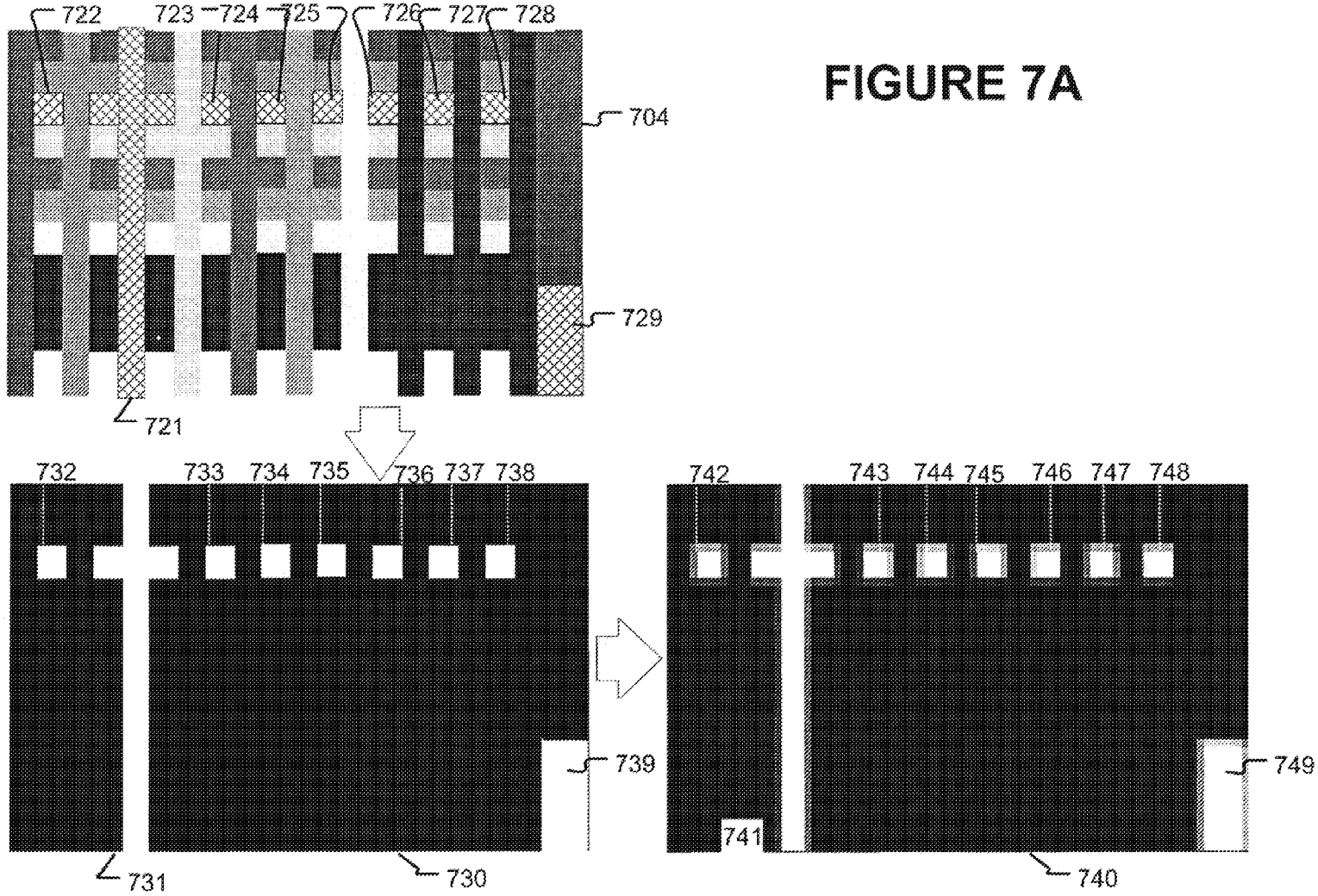
FIGS. 7A-7B illustrate an example of operating a rear modulator with color hierarchical convex combination techniques, according to at least some embodiments of the invention.
Figure 7B:
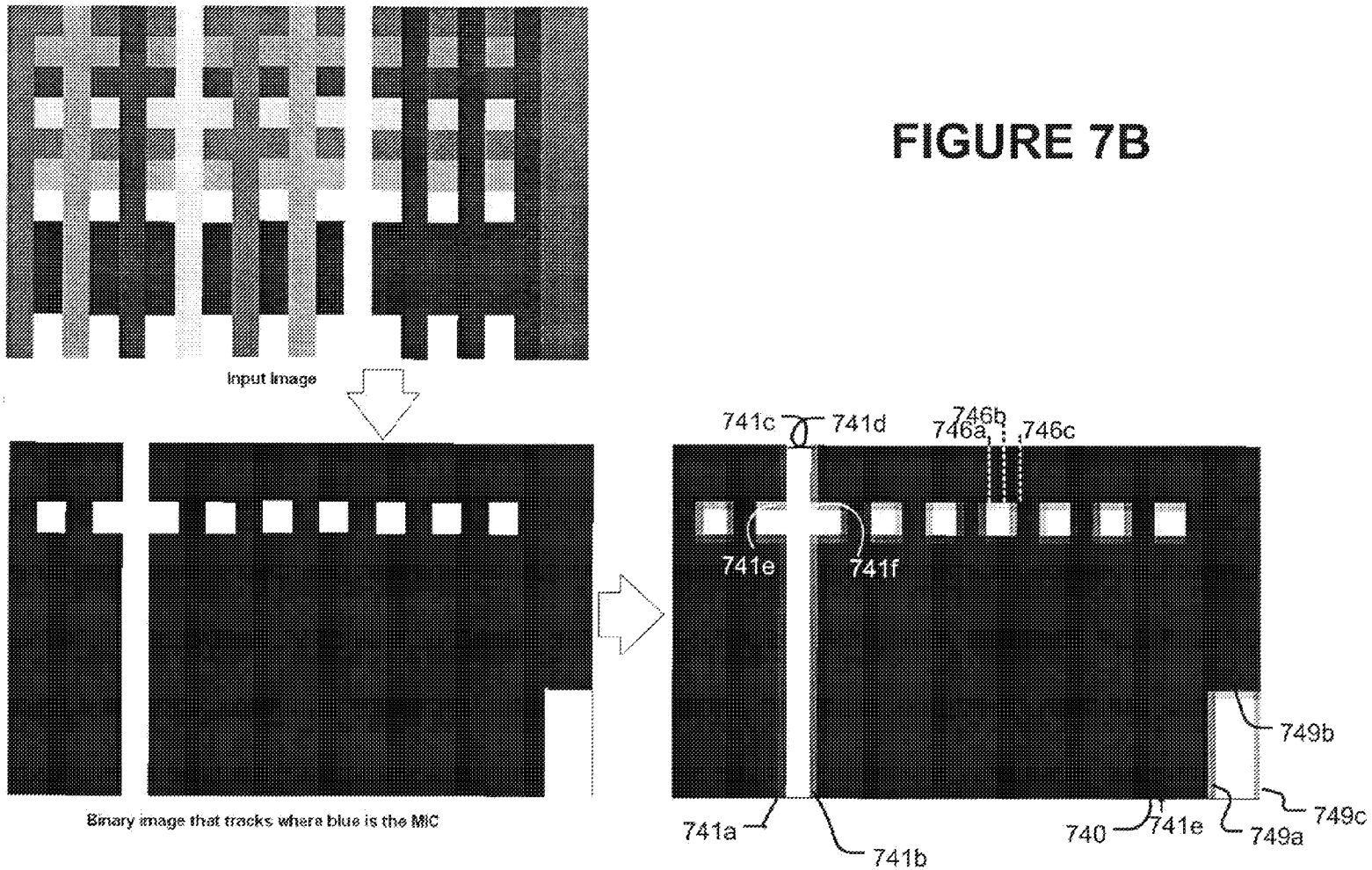

FIGS. 7A-7B illustrate an example of operating a rear modulator with color hierarchical convex combination techniques, according to at least some embodiments of the invention. Here in FIG. 7A, input image 704 includes a plurality of colors, including blue, which is indicated by cross-hatched portions 721-729. Color importance map (CIM) 730 is generated at block 624. White areas 731-739, in this example, are indicative of portions 721-729 where blue is considered a most important color (MIC), while the remaining black portions of CIM 730 are indicative of other colors that are not prioritized as the MIC. In some embodiments, CIM 730 is a histogram indicative of white pixels representing portions where in the input image blue is a MIC. Color importance weight map (CIWM) 740 is generated at block 625. According to some embodiments, CIWM 740 includes portions 741-749 that correspond to portions 731-739 but appear to have dimmer areas (that are depicted visually as blurred or softened interfaces between areas of white and black pixels).

FIG. 7B illustrates a magnified version of CIWM 740. Here in FIG. 7B, CIWM 740 includes dim areas 741*a-f*, 746*a-c*, and 749*a-c*, by way of illustration. CIWM 740 indicates the relative weighting of a MIC for particular portions 741-749 of a sub-image. For example, the higher a certain pixel value is for given area in the CIWM, the more weight is given to the target backlight drive levels in determining the actual drive levels to be used for the backlight. As a corollary, the dimmer a certain pixel value is for a given area in the CIWM, the more weight is given to the initially determined backlight drive levels. Each of dim areas 741*a-f*, 746*a-c*, and 749*a-c* in FIG. 7B is indicative of fewer pixels that have blue as the most important color for those regions of the image. The remaining black portions of CIWM 740 are indicative of other colors in image 704 where blue is not a MIC. Varying degrees of gray-tone in dim areas 741*a-f*, 746*a-c*, and 749*a*-cindicates a varying mixture of black and white pixels at the corresponding portions of CIM 730. As depicted here, a darker shaded area such as 746*a* is an indicator of a dimmer drive level than a lighter gray area 746*b*.

Figure 8A:
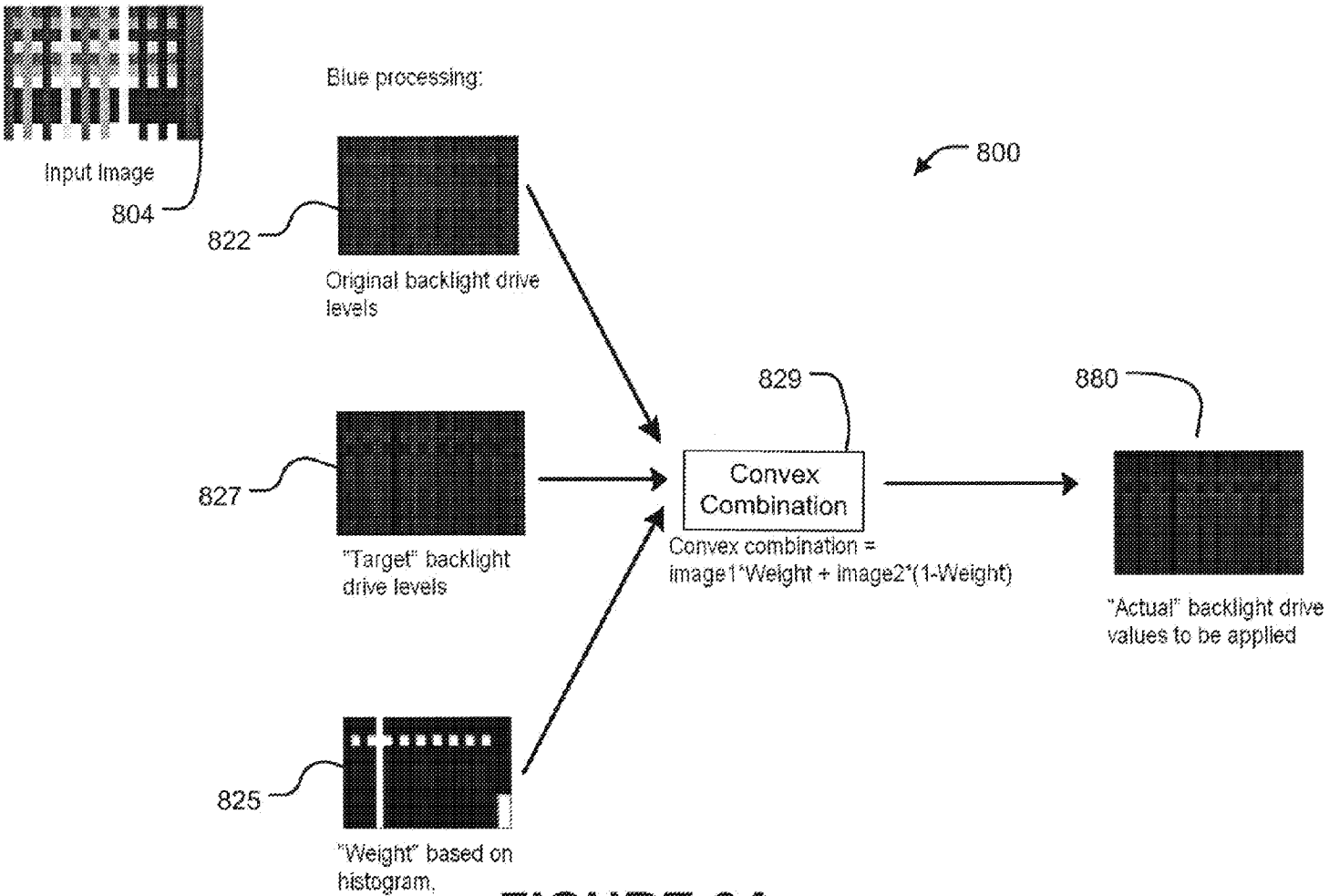
FIGS. 8A to 8D illustrate an example of operating a rear modulator with color hierarchical convex combination techniques, according to at least some embodiments of the invention.

FIG. 8A illustrates an example of operating a rear modulator with color hierarchical convex combination techniques, according to at least some embodiments of the invention. Here in diagram 800, input image 804 is received by block 622 of FIG. 6. Block 622 determines rear modulator drive levels associated with sub-image 822 (e.g., original backlight drive levels for blue). Blocks 627 and 628 determine the target drive levels as indicated by sub-image 827. The color importance weight map 825 is determined by block 625. Block 629 translates the drive levels for sub-image 822, the drive levels for sub-image 827 and the CIWM 825 using a combination function 829 into the effective rear modulator drive levels 880 (also referred to as the "actual backlight drive values to be applied" to rear modulator) at block 680. In some examples, combination function 829 may be a convex combination as described with respect to Eq. (2).

Figure 8B:
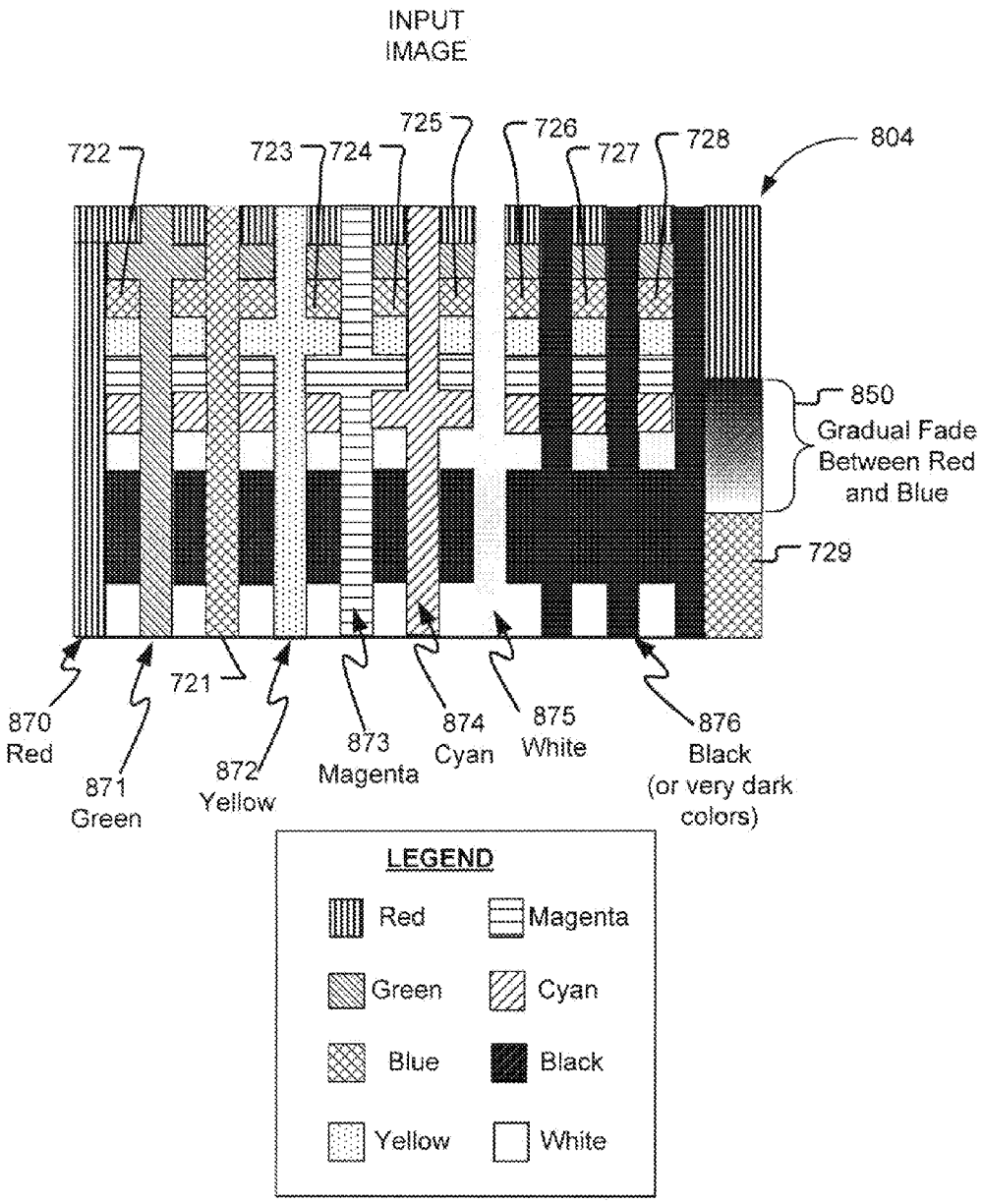
Figure 8C:
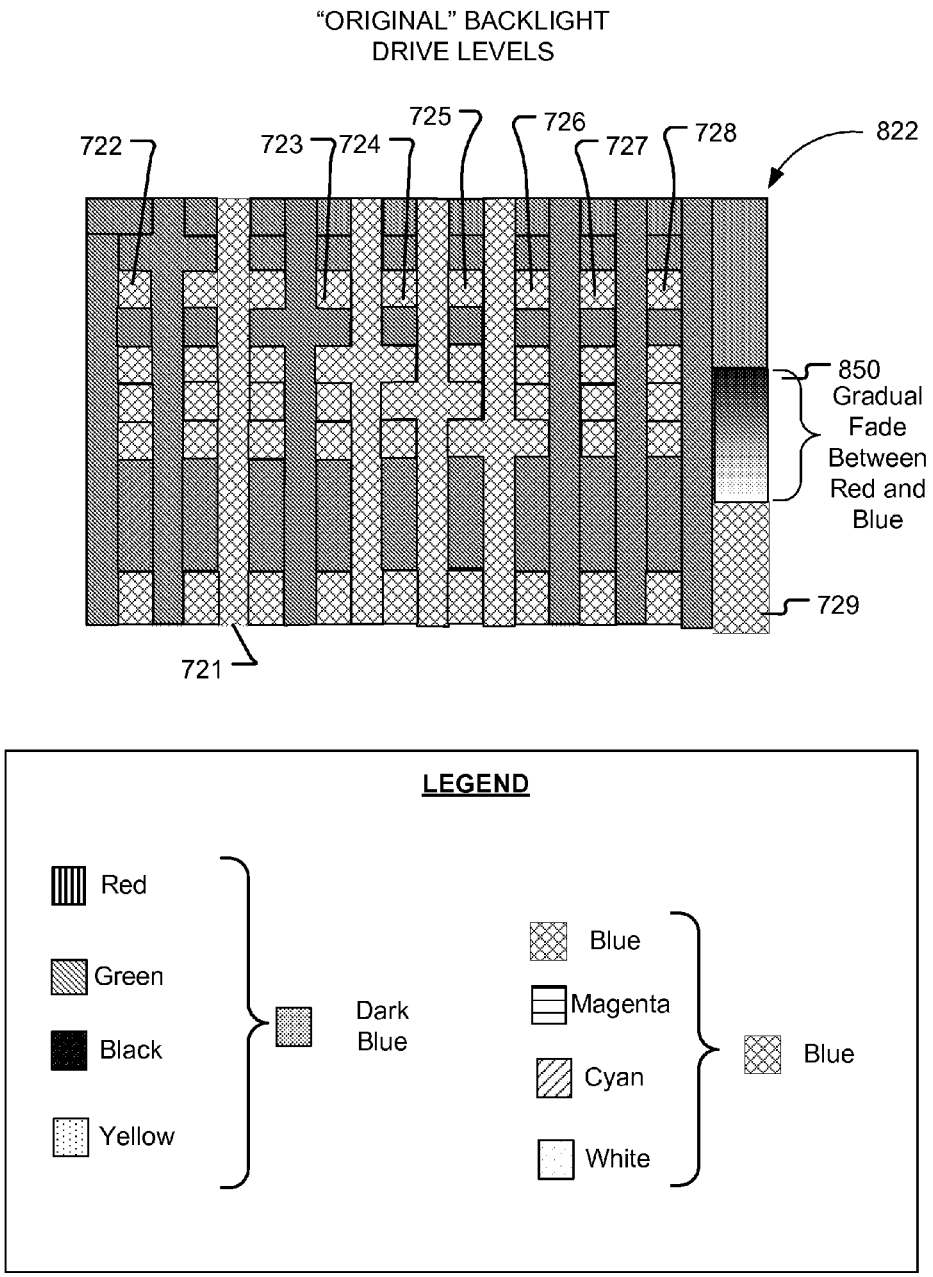
Figure 8D:
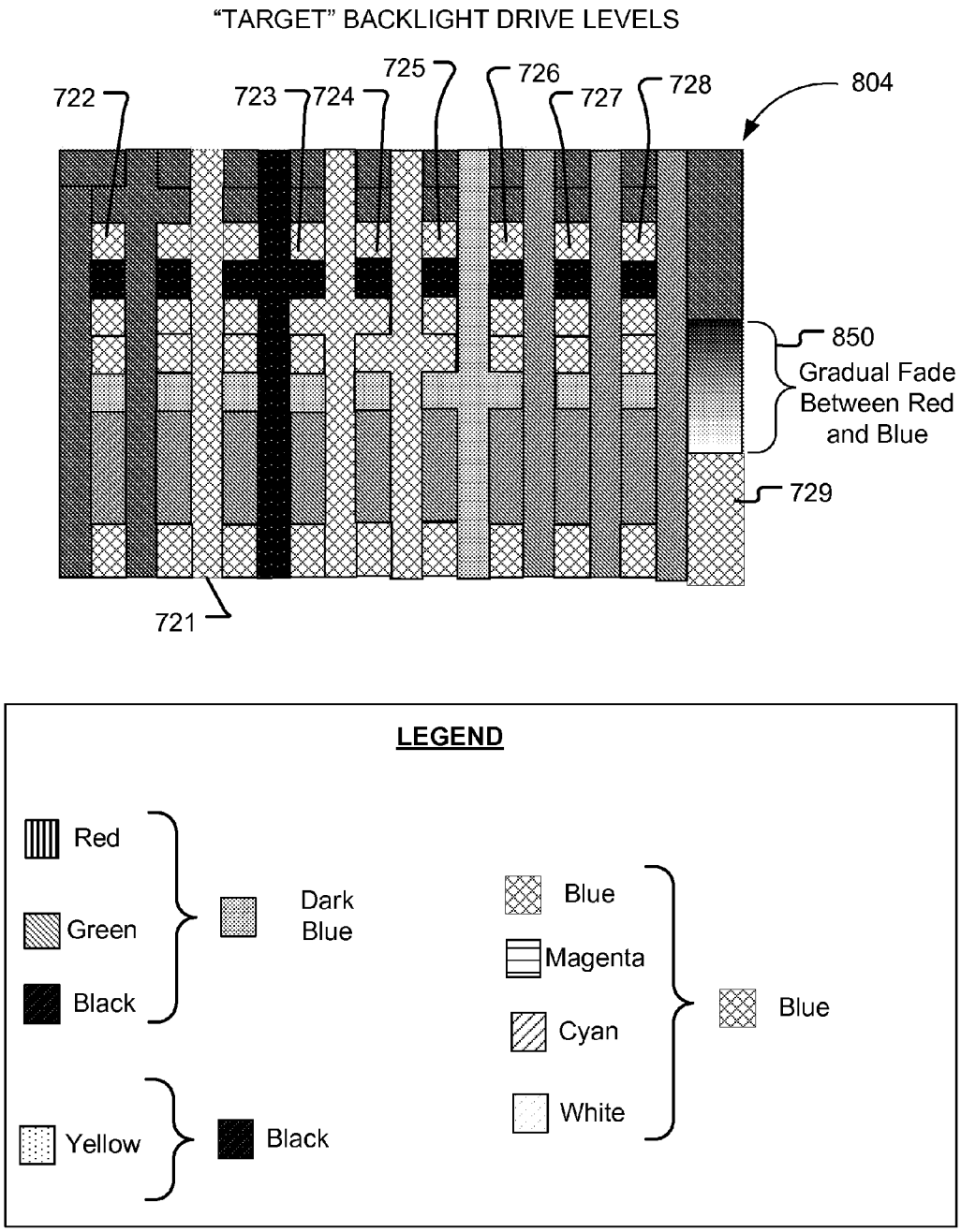

FIG. 8B depicts input image 804 with different colors specifically identified, according to an embodiment. As shown, input image 804 includes a red color features 870, green color features 871, blue color features including portions 721-728, yellow color features 872, magenta color features 873, cyan color features 874, white color features 875, and black color features 876 (e.g., any dark color, such as very dark green, blue or brown). Color errors, if any, generally are perceptible at the interfaces between the color features. Also shown is an area 850 at which there is a gradual fade between red and blue colors. FIG. 8C depicts a sub-image 822 as a back light for a blue color channel. As shown, colors that include blue (e.g., magenta, cyan, white, and blue) are marked as being "blue," whereas colors that do not include blue (e.g., red, green, yellow, and black) are marked as being "dark blue" or "low luminance blue," according to an embodiment. FIG. 8D depicts a target sub-image 827 with color compensation as described herein, for example. As shown, the color yellow is "black," which means that the color yellow is not present in the blue color channel as blue is not the most important color in the yellow color features 872. Sub-image 822 of FIG. 8C and sub-image 827 of FIG. 8D are combined using a weight 825 to determine actual back light drive signal values, which can also provide for transitions (e.g., gradual fade areas) in back light sub-image 880.

Figure 9:
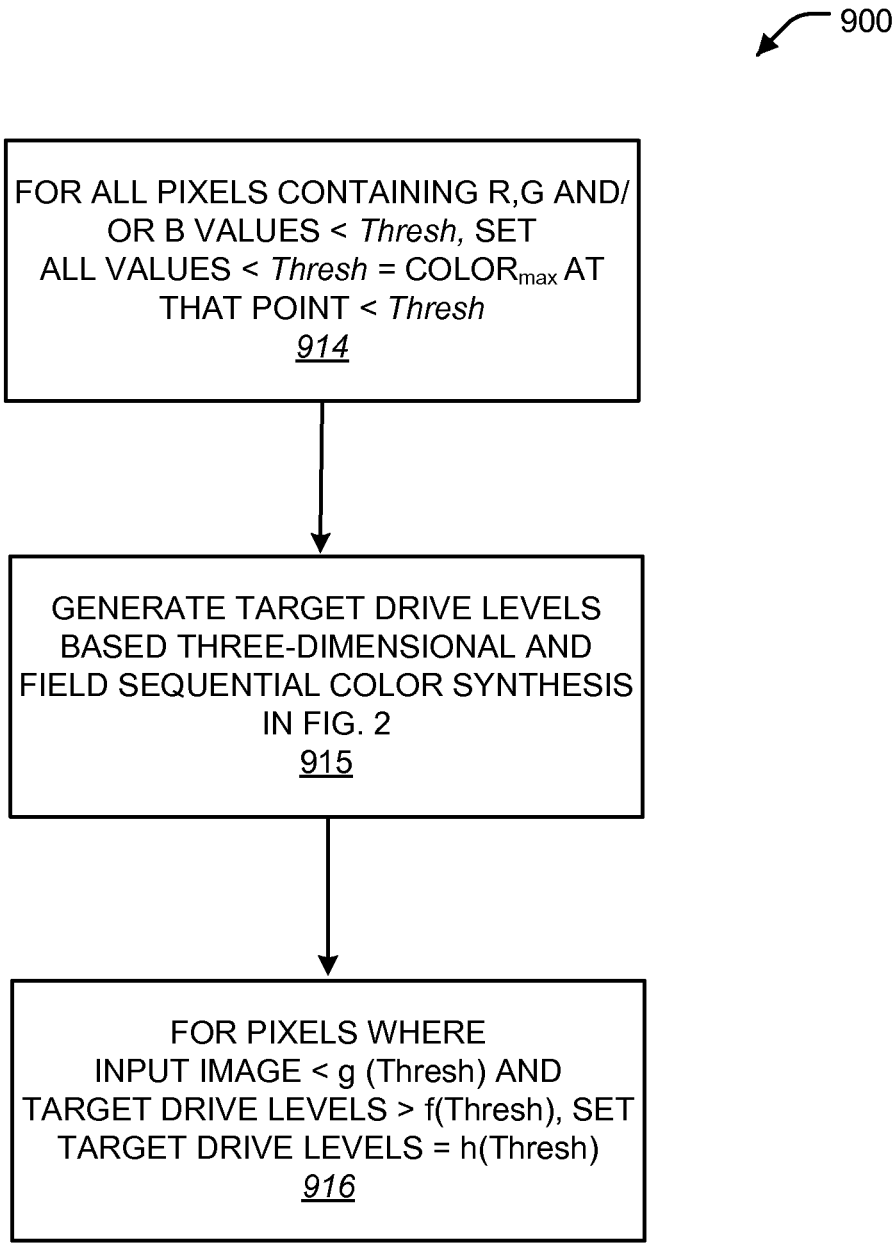
FIG. 9 illustrates a flowchart representing an example of operating a rear modulator with low end threshold (LET) techniques, according to some embodiments of the invention.

FIG. 9 illustrates a flowchart representing an example of operating a rear modulator with low end threshold (LET) techniques, according to some embodiments of the invention. Here, flowchart 900 includes block 914 which may be configured to identify those pixels with R, G and/or B values being less than a threshold value (Thresh), and to set those identified values that are less than Thresh equal to a maximum color value ($Color_{Max}$) of those identified values. By doing so, the rear modulator may be precluded in the next block 915 from attempting to drive a color (having color errors and requiring compensation) to a very high level (i.e., bright) in order to accurately reproduce a target (desired) color in image portions where one or more colors have low pixel values relative to the color having color errors, which may have a higher pixel value than that of one or both of the other colors (i.e., in a color space, of three colors such as R, G and B) and for which the front modulator was modulating with color errors (as determined from block 220 in FIGS. 2A-2B). This mitigation of potential oversaturation of particular low pixel values for a color may be undertaken because the pixel value of the color requiring correction is low such that the human visual system may not be able to perceive slight errors in colors that may contribute such low luminance.

Block 915 generates the target drive levels based on the three-dimensional and field sequential color synthesis techniques described herein and illustrated, by way of examples, in FIGS. 2A-2B or FIG. 6.

Block 916 is configured to set the replacement rear modulator drive levels (e.g., target rear modulator drive levels determined by block 244) to a first function (h(Thresh)) when block 916 has determined pixels in an input image having values less than a second function (g(Thresh)), and when block 916 has determined that the replacement rear modulator drive levels are greater than a third function (f(Thresh)). In some examples, drive levels associated with the replacement sub-images may be assigned to a cutoff value determined by a function, h, when color associated with the input image is less than a cutoff value determined by a function, g, and when the drive levels associated with the replacement sub-image are greater than a value determined by a function, f. Table 1 provides exemplary descriptions of the functions f, g, and h as follows.

TABLE 1

| Function | Description |
|---|---|
| g | a function to determine a cutoff value |
| f | a function to determine a limiting value of the replacement luminance pattern (e.g., target rear modulator luminance profile) (the drive levels are determined from the down sampling) |
| h | a function that may produce the replacement rear modulator drive levels where target rear modulator drive levels may be limited by function f |

The parameter Thresh may be configured to characterize a low end cutoff value below which pixel values may not be important because the human visual system would be unable to perceive a color at such pixel value. In some examples, Thresh=0.1, g=Thresh, f=3*Thresh, and h=3*Thresh=g. Block 916 is configured to limit the target rear modulator drive levels in portions of a sub-image where block 915 produces a high drive level, but where the corresponding input image indicates a low luminance level for that color. Limiting the target rear modulator drive levels in this manner may mitigate artifacts arising from excess light pollution in adjacent image areas, caused by overlapping point spread functions from different modulating elements, as it may not be necessary to reproduce low luminance light in a dark portions of a sub-image with precision because of mescopic vision effects upon the human visual system.

Figure 10:
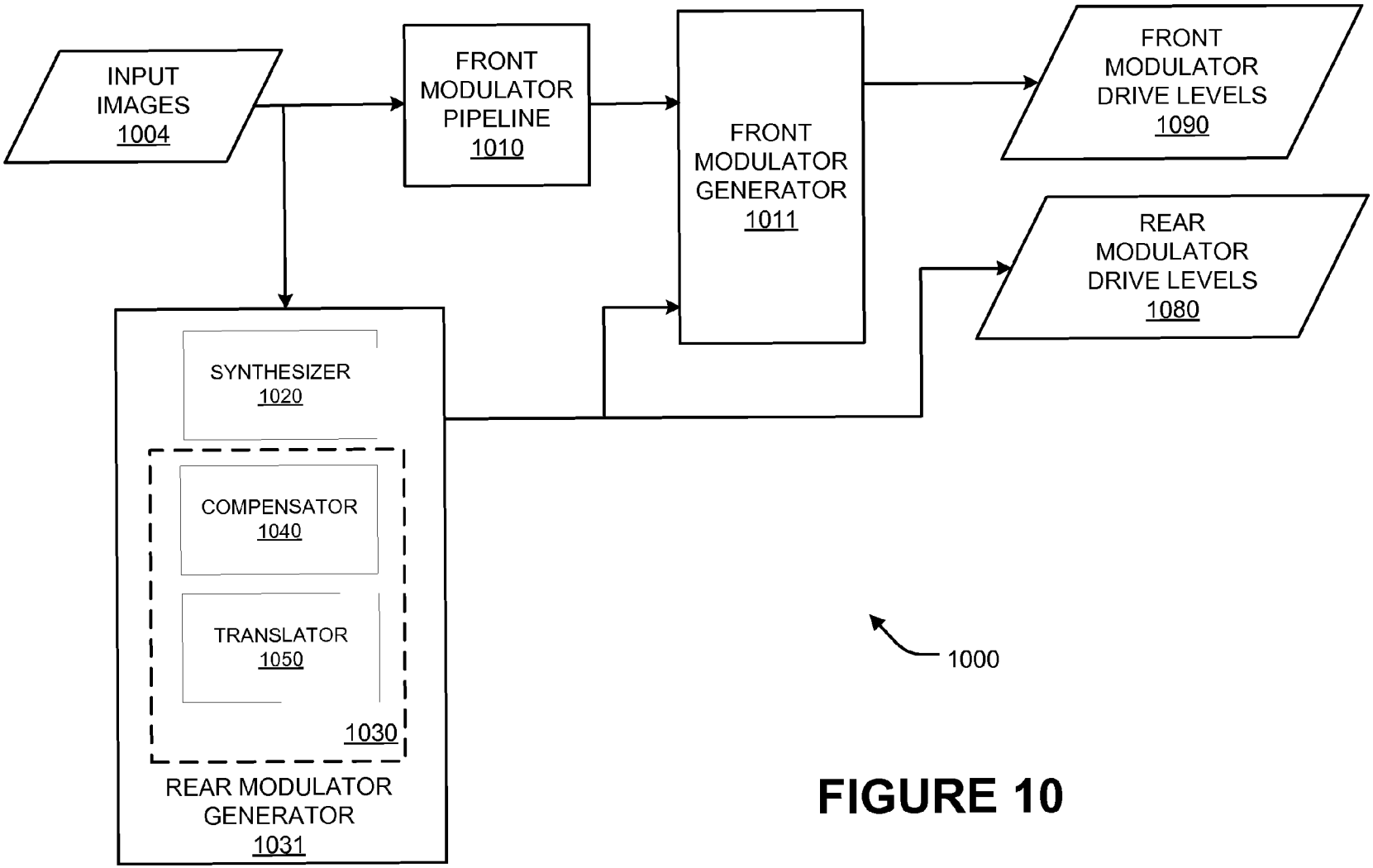
FIG. 10 illustrates a block diagram of an exemplary controller to operate front and rear modulators, according to some embodiments of the invention.

FIG. 10 illustrates a block diagram of an exemplary controller to operate front and rear modulators, according to some embodiments of the invention. Here, display controller 1000 includes a rear modulator generator 1031, a front modulator pipeline 1010, and a front modulator generator 1011. Rear modulator generator 1031 may include a synthesizer 1020, and a color corrector 1030 having a compensator 1040 and a translator 1050, all configured to provide the respective functions described herein. Input images 1004 may be provided as gamma-encoded images in some examples to both rear modulator generator 1031 and front modulator pipeline 1010. Rear modulator generator 1031 may generate rear modulator drive signals 1080 to control the operation of a rear modulator. That is, deriving content from input image 1004 and using the methods, techniques and description provided herein, appropriate driving levels for each modulating element of a rear modulator may be determined. Front modulator generator 1011 may generate front modulator signals 1090 to control the operation of a front modulator, based upon input from front modulator pipeline 1010, and rear modulator drive signals. Front modulator pipeline 1010 may include the generation of front modulator output values that produce the desired overall light output and white point. For example, pipeline 1010 may apply color correction techniques, dividing the values by a light simulation output, correcting for gamut and front modulator response. The input images 1004 may be adjusted to an optimal display on a front modulator given the corresponding light field.

Reference to color errors may refer to visual artifacts in image areas arising within the context of the description for block 220 of FIG. 2, by way of examples, and attributed to the front modulator lacking full color control when used with an operable pixel mosaic, according to some embodiments. In the context of block 220, and by way of examples, the rear modulator may not have accounted for inaccuracies arising when a pixel is controlled to select its value based on a comparison between either red and blue (for magenta sub-pixel element) or green and blue (for cyan sub-pixel element). In some examples, the selection may have been based on which of those colors had a higher RGB value, that is, the value that would enable that color to be modulated without color error, after which that pixel would drive its associated second color(s) to the same value to attempt the cyan-magenta mosaic to be modulated without color errors. However, inherent with the use of a non-standard, 2-color pixel mosaic is the lack of full color control over the front modulator for all colors, and in those examples where the color selection is based on the maximum of RGB values, such color errors arise because of the lack of rear modulator compensation to address the lack of full color control by the front modulator. As a corollary, reference to "without color errors" may refer to the front modulator modulating a sub-image for a certain color or colors without these artifacts arising. By way of examples, and as depicted in FIG. 2B, sub-image 272 was modulated without color errors for the color yellow (having red and green colors) by the front modulator. In such examples, the color yellow would not require color compensation in blocks 242 and 244, as opposed to the color blue.

Reference to color hierarchical convex combination (CHCC) may refer to determining suitable rear modulator drive levels for systems that may be configured to choose their color priority, according to some embodiments.

Reference to a color importance map (CIM) may refer to an array of color priority rankings indicative of the color priority for each pixel of an image or sub-image, according to some embodiments.

Reference to color priority or to color prioritization may refer to rankings of colors in an image or part of an image, and may in some examples, refer to determining which color or colors may be perceptually the most important to reproduce an input image without color errors, according to some embodiments.

Reference to a contrast ratio may refer to a ratio determined by the luminance resulting from full-on and full-off modulator signals, according to some embodiments.

Reference to field sequential color synthesis may refer to the production of perceptually full color images using different temporal frames in rapid sequence, and may refer to techniques disclosed in the U.S. Patent Application Publication No. US 2008/0186344 A1, entitled "Field Sequential Display of Color Images," the contents of which are hereby incorporated by reference in its entirety and for all purposes, according to some embodiments.

Reference to high dynamic range may describe images and imaging systems that can display images with a large brightness ratio of light transmitted at the brightest state and light transmitted at the darkest states, according to some embodiments.

Reference to liquid crystal display may refer to a transmissive optical technology and/or component(s) that can change the state of polarization of incident light (e.g., on a pixel-by-pixel basis) between 0 and 90 degrees and transmits the light with the altered characteristics, according to some embodiments, and that is capable of performing spatial modulation in other embodiments.

Reference to local and global color priority may refer respectively to a color prioritization scheme that is determined relative to image portions based on a certain color, like the most important color, and as contrasted with a scheme where color is prioritized over the entire sub-image, according to some embodiments.

Reference to low end threshold may refer to artifact reduction techniques that may be utilized with three-dimensional and field sequential color synthesis techniques, according to some embodiments.

Reference to a most important color (MIC) may refer to a color or colors which have been prioritized as having the highest priority, and which may be determined in a number of ways, including those disclosed in U.S. Patent Application Publication No. US 2008/0186344 A1, entitled "Field Sequential Display of Color Images," the contents of which are hereby incorporated by reference in its entirety and for all purposes, according to some embodiments.

Reference to "not identified (or prioritized) as most important" may be referred interchangeably to "identified (or prioritized) as not most important," according to some embodiments.

Reference to RGB may refer to a normalized color space for red, green and blue light that may map each primary color to a linear luminance scale starting at zero, according to some embodiments.

Reference to three-dimensional color synthesis may refer to the production of full color images using non-standard pixel mosaics and rear modulators (e.g., backlights), and may include those techniques disclosed in U.S. Provisional Patent Application No. 60/667,506, filed on Apr. 1, 2005, entitled "Three-Dimensional Color Synthesis for Enhanced Display Image Quality," the contents of which are hereby incorporated by reference in its entirety and for all purposes, according to some embodiments.

The described systems, apparatuses, integrated circuits, computer-readable media, and methods may be applicable to a variety of applications. In some examples, one or more embodiments may be implemented in a device that is configured to display an image with motion (e.g., video), images without motion, pictorial images, and/or text. In other examples, one or more embodiments may be implemented with devices, such as, but not limited to, appliances, architectural structures, aesthetic art work, audio-visual devices, calculators, camcorders, camera displays, clocks, computer monitors, digital modulator projection systems, data projectors, digital cinema, digital clocks, electronic photographs, electronic billboards, electronic devices, electronic signs, game console and peripheral devices, graphic arts, high dynamic range (HDR) displays, home theater systems and media devices, flat panel displays, global positioning sensors (GPS) and navigators, handheld computers, large displays, medical devices, medical imaging devices or systems, MP3 players, mobile telephones, packaging, personal digital assistants (PDAs), portable computers, portable projectors, projection systems, stereoscopic displays, surveillance monitors, televisions, television displays, vehicle-related control and/or monitoring displays (e.g., cockpit displays, windshield display, dashboard display, motorcycle helmet visor display, vehicular rear view camera displays etc . . . ), watches, and wireless devices.

In some embodiments, the functions and/or sub-processes may be performed by any structure described herein.

In some examples, the methods, techniques and processes described herein may be performed and/or executed by software instructions on computer processors. For example, one or more processors in a computer or other display controller may implement the methods of FIGS. 2A-2B, 5A-5C, and 6-9, by executing software instructions in a program memory (e.g., storage/memory 317 of FIG. 3) accessible to a processor. Additionally, the methods, techniques and processes described herein may be performed with full frame images using a graphics processing unit (GPU) or a control computer, or field-programmable gate array (FPGA) coupled to the display. These methods, techniques and processes may also be provided in the form of a program product, which may comprise any medium and/or media which carries a set of computer-readable instructions which, when executed by a data processor, cause the data processor to execute such methods, techniques and/or processes. Program products, may include, but are not limited to: physical media such as magnetic data storage media, including floppy diskettes, and hard disk drives; optical data storage media including CD ROMs, and DVDs; electronic data storage media, including ROMs, flash RAM, non-volatile memories, thumb-drives, or the like; and transmission-type media, such as digital or analog communication links, virtual memory, hosted storage over a network or global computer network, and networked-servers.

In at least some examples, the structures and/or functions of any of the above-described features can be implemented in software, hardware, firmware, circuitry, or a combination thereof. Note that the structures and constituent elements above, as well as their functionality, may be aggregated with one or more other structures or elements. Alternatively, the elements and their functionality may be subdivided into constituent sub-elements, if any. As software, the above-described techniques may be implemented using various types of programming or formatting languages, frameworks, syntax, applications, protocols, objects, or techniques, including C, Objective C, C++, C#, Flex™, Fireworks®, Java™, Javascript™, AJAX, COBOL, Fortran, ADA, XML, HTML, DHTML, XHTML, HTTP, XMPP, Ruby on Rails, and others. These can be varied and are not limited to the examples or descriptions provided.

Various embodiments or examples of the invention may be implemented in numerous ways, including as a system, a process, an apparatus, or a series of program instructions on a computer readable media and/or computer readable medium such as a computer readable storage media or a computer network where the program instructions are sent over optical, electronic, or wireless communication links. In general, operations of disclosed processes may be performed in an arbitrary order, unless otherwise provided in the claims.

A detailed description of one or more examples is provided herein along with accompanying figures. The detailed description is provided in connection with such examples, but is not limited to any particular example. The scope is limited only by the claims, and numerous alternatives, modifications, and equivalents are encompassed. Numerous specific details are set forth in the description in order to provide a thorough understanding. These details are provided as examples and the described techniques may be practiced according to the claims without some or all of the accompanying details. They are not intended to be exhaustive or to limit the invention to the precise forms disclosed, as many alternatives, modifications, equivalents, and variations are possible in view of the above teachings. For clarity, technical material that is known in the technical fields related to the examples has not been described in detail to avoid unnecessarily obscuring the description.

The description, for purposes of explanation, uses specific nomenclature to provide a thorough understanding of the invention. However, it will be apparent that specific details are not required in order to practice the invention. In fact, this description should not be read to limit any feature or aspect of the present invention to any embodiment; rather, features and aspects of one example can readily be interchanged with other examples. Notably, not every benefit described herein need be realized by each example of the present invention; rather, any specific example may provide one or more of the advantages discussed above. In the claims, elements and/or operations do not imply any particular order of operation, unless explicitly stated in the claims. It is intended that the following claims and their equivalents define the scope of the invention.

The invention claimed is:

1. A method to generate a backlight sub-image of an input image, comprising:

determining an array of color priority rankings associated with the input image, the array including a first portion associated with a first subset of colors that are identified as most important and a second portion associated with a second subset of colors at which the first subset of colors is not identified as most important;

determining an estimated sub-image having the first and second subsets of colors, wherein the estimated sub-image comprises a high resolution representation of the input image, the estimated sub-image configured to be reproduced on a front modulator, the estimated sub-image comprising first areas being compensated by the first portion to enable the estimated sub-image to be reproduced with the first subset of colors and without color errors where the first subset of colors is prioritized as most important, and second areas configured by the second portions to enable the estimated sub-image to be reproduced with the second subset of colors in the second areas where the first subset of colors is not prioritized as most important;

generating an initial sub-image, wherein the initial sub-image comprises a low resolution representation of the input image, wherein the initial sub-image has initial backlight drive levels which are based upon full color control of the front modulator and is configured to be reproduced on the backlight;

generating a replacement sub-image based on dividing the input image by the estimated sub-image, wherein the replacement sub-image comprises a low resolution representation of the input image, the replacement sub-image configured to be reproduced on a backlight, wherein the combination of the low resolution representation of the input image reproduced on the backlight and the high resolution representation of the input image reproduced on the front modulator produces the input image;

applying a combination function to the replacement sub-image and the initial sub-image to derive effective backlight drive levels; and applying a signal indicative of the effective backlight drive levels to effectuate display of the backlight sub-image;

wherein determining an array of color priority rankings further comprises:

identifying a maximum color value among the first and second subsets of colors; and assigning the maximum color value to each of certain ones of the first and second subsets of colors that are determined to be below a threshold value (Thresh);

the method further comprising:

assigning drive levels associated with the replacement sub-image to a first cutoff value represented by a function (h) when color data values associated with the input image is less than a second cutoff value represented by a function (g) and when drive levels associated with the replacement sub-image are greater than a cutoff value represented by a function (f).

2. The method of claim 1, wherein the estimated sub-image is determined without color errors for N colors in an image display system with a color filter comprising a pixel mosaic with N sub-pixel elements, wherein the color filter is disposed along an optical path of the front modulator.

3. The method of claim 2, wherein N=2 and the color filter is a two-color pixel mosaic comprising two sub-pixel elements.

4. The method of claim 1, wherein the estimated sub-image is determined without color errors for locally determined colors based on color prioritization techniques.

5. The method of claim 1, wherein determining an array of color priority rankings comprises:

generating a color importance map to include the first and second portions as binary representations of each other.

6. The method of claim 1, wherein the first subset of colors being prioritized as most important is based on a color priority scheme using photopic ratios of red, green and blue colors.

7. The method of claim 1, wherein applying the combination function comprises:

applying an average between the replacement sub-image and the initial sub-image.

8. The method of claim 1, wherein applying the combination function comprises:

applying a weighted combination of the replacement sub-image and the initial sub-image.

9. The method of claim 1, wherein applying the combination function comprises:

applying a combination function to luminance intensities associated with the replacement sub-image and the initial sub-image and to an array of weighted-averages so as to derive effective backlight drive levels, wherein the array of weighted-averages is indicative of a percentage of the first subset of colors prioritized as most important with respect to the percentage of the second subset of colors.

10. The method of claim 1, wherein the array of weighted-averages constitutes a histogram.

11. The method of claim 10, wherein the combination function constitutes a color hierarchical convex combination.

12. The method of claim 1, wherein the initial sub-image is determined from a simulated light field, wherein the simulated light field is a prediction or estimate of the light field to be projected by the backlight onto the front modulator.

13. The method of claim 1, wherein, Thresh =0.1, g=Thresh, f=3*Thresh, and h=3*Thresh.

14. The method of claim 1, wherein generating the replacement sub-image comprises predicting the replacement sub-image based on a point spread function of the backlight by applying a reverse blur simulation to the replacement sub-image.

15. A controller that implements the method of claim 1.

16. An image display system, comprising:

a backlight operable to generate a backlight sub-image being a low resolution representation of an input image, the backlight sub-image being formed from a color importance map configured to facilitate color correction of a certain one of first and second subsets of colors derived from the input image;

a front modulator configured to be illuminated by light associated with the backlight sub-image so as to produce an intermediate sub-image, the backlight sub-image enabling the intermediate sub-image having the first and second subsets of colors to be generated without color errors associated with one of the first and second subsets of colors;

a pixel mosaic disposed on the pixels of the front modulator to filter the intermediate sub-image to thereby produce a displayable image representing the input image; and the controller of claim 15.

17. A method to generate a backlight sub-image of an input image, comprising:

determining an array of color priority rankings associated with the input image, the array including a first portion associated with a first subset of colors that are identified as most important and a second portion associated with a second subset of colors at which the first subset of colors is not identified as most important;

determining an estimated sub-image having the first and second subsets of colors, wherein the estimated sub-image comprises a high resolution representation of the input image, the estimated sub-image configured to be reproduced on a front modulator, the estimated sub-image comprising first areas being compensated by the first portion to enable the estimated sub-image to be reproduced with the first subset of colors and without color errors where the first subset of colors is prioritized as most important, and second areas configured by the second portions to enable the estimated sub-image to be reproduced with the second subset of colors in the second areas where the first subset of colors is not prioritized as most important;

generating an initial sub-image, wherein the initial sub-image comprises a low resolution representation of the input image, wherein the initial sub-image has initial backlight drive levels which are based upon full color control of the front modulator and is configured to be reproduced on the backlight;

generating a replacement sub-image based on dividing the input image by the estimated sub-image, wherein the replacement sub-image comprises a low resolution representation of the input image, the replacement sub-image configured to be reproduced on a backlight, wherein the combination of the low resolution representation of the input image reproduced on the backlight and the high resolution representation of the input image reproduced on the front modulator produces the input image;

applying a combination function to the replacement sub-image and the initial sub-image to derive effective backlight drive levels; and applying a signal indicative of the effective backlight drive levels to effectuate display of the backlight sub-image;

wherein the color hierarchical convex combination comprises:

$$LP_{effective}=\text{Image}_1*\text{Weight}+\text{Image}_2*(1-\text{Weight}),$$

wherein the $LP_{effective}$ comprises effective light patterns corresponding to the effective drive levels, the $\text{Image}_1$ comprises the initial sub-image, the $\text{Image}_2$ comprises the replacement sub-image, and the Weight comprises the histogram.

18. The method of claim 17, wherein determining an array of color priority rankings further comprises:

identifying a maximum color value among the first and second subsets of colors; and assigning the maximum color value to each of certain ones of the first and second subsets of colors that are determined to be below a threshold value (Thresh).

19. A digital cinema projector comprising a backlight and a primary modulator in a dual modulation architecture;

the digital cinema projector further comprising:

a controller configured to rank an array of color priorities associated with an input image, the array including a first portion associated with a first subset of colors that are identified as most important and a second portion associated with a second subset of colors at which the first subset of colors is not identified as most important;

the controller further configured to determine an estimated sub-image having the first and second subsets of colors, wherein the estimated sub-image comprises a high resolution representation of the input image, the estimated sub-image configured to be reproduced on the primary modulator, the estimated sub-image comprising first areas being compensated by the first portion to enable the estimated sub-image to be reproduced with the first subset of colors and without color errors where the first subset of colors is prioritized as most important, and second areas configured by the second portions to enable the estimated sub-image to be reproduced with the second subset of colors in the second areas where the first subset of colors is not prioritized as most important;

the controller further configured to generate an initial sub-image, wherein the initial sub-image comprises a low resolution representation of the input image, wherein the initial sub-image has initial backlight drive levels which are based upon full color control of the front modulator and is configured to be reproduced on the backlight and generating a replacement sub-image based on dividing the input image by the estimated sub-image, wherein the replacement sub-image comprises a low resolution representation of the input image, the replacement sub-image configured to be reproduced on the backlight, wherein the combination of the low resolution representation of the input image reproduced on the backlight and the high resolution representation of the input image reproduced on the front modulator produces the input image;

the controller further configured to apply a combination function to the replacement sub-image and the initial sub-image to derive effective backlight drive levels, and apply a signal indicative of the effective backlight drive levels to effectuate display of the backlight sub-image;

wherein the controller is further configured to determine the array of color priority rankings via identification of a maximum color value among the first and second subsets of colors, and to assign the maximum color value to each of certain ones of the first and second subsets of colors that are determined to be below a threshold value (Thresh);

the controller further configured to assign drive levels associated with the replacement sub-image to a first cutoff value represented by a function (h) when color data values associated with the input image is less than a second cutoff value represented by a function (g) and when drive levels associated with the replacement sub-image are greater than a cutoff value represented by a function (f).

* * * * *